US009468582B2

(12) United States Patent
Lin et al.

(10) Patent No.: US 9,468,582 B2
(45) Date of Patent: Oct. 18, 2016

(54) INFLATABLE SPA

(71) Applicant: Intex Recreation Corp., Long Beach, CA (US)

(72) Inventors: Hua Hsiang Lin, Fujian (CN); Yaw Yuan Hsu, Fujian (CN)

(73) Assignee: INTEX MARKETING LTD., Tortola (VG)

( * ) Notice: Subject to any disclaimer, the term of this patent is extended or adjusted under 35 U.S.C. 154(b) by 0 days.

(21) Appl. No.: 15/001,507

(22) Filed: Jan. 20, 2016

(65) Prior Publication Data

US 2016/0136043 A1 May 19, 2016

Related U.S. Application Data

(63) Continuation of application No. 14/444,474, filed on Jul. 28, 2014, now Pat. No. 9,254,240, and a continuation of application No. PCT/US2014/047252, filed on Jul. 18, 2014, and a continuation of application No. PCT/US2014/068884, filed on Dec. 5, 2014.

(30) Foreign Application Priority Data

| | | |
|---|---|---|
| Jul. 18, 2013 | (CN) | 2013 2 0428910 U |
| Nov. 21, 2013 | (CN) | 2013 2 0745798 U |
| Nov. 21, 2013 | (CN) | 2013 2 0745863 U |
| Nov. 21, 2013 | (CN) | 2013 2 0745887 U |
| Nov. 21, 2013 | (CN) | 2013 2 0746974 U |
| Dec. 5, 2013 | (CN) | 2013 2 0796506 U |
| Dec. 30, 2013 | (CN) | 2013 2 0888403 U |
| Dec. 30, 2013 | (CN) | 2013 2 0888639 U |
| Dec. 30, 2013 | (CN) | 2013 2 0892855 U |
| Jan. 15, 2014 | (CN) | 2014 1 0017358 |
| Jan. 15, 2014 | (CN) | 2014 2 0023673 U |
| Jan. 26, 2014 | (CN) | 2014 2 0050705 U |
| Jul. 8, 2014 | (CN) | 2014 2 0375437 U |
| Dec. 4, 2014 | (NL) | 2013918 |

(51) Int. Cl.
*A47K 3/06* (2006.01)
*A61H 33/02* (2006.01)
(Continued)

(52) U.S. Cl.
CPC ..... *A61H 33/028* (2013.01); *A47K 3/06* (2013.01); *A61H 33/0087* (2013.01);
(Continued)

(58) Field of Classification Search
CPC ..... A47K 3/06
USPC ..... 4/538–595
See application file for complete search history.

(56) References Cited

U.S. PATENT DOCUMENTS

| | | | |
|---|---|---|---|
| 573,122 | A | 12/1896 | Young |
| 818,321 | A | 4/1906 | Whall |

(Continued)

FOREIGN PATENT DOCUMENTS

| | | |
|---|---|---|
| CH | 197243 | 4/1938 |
| CH | 438622 | 6/1967 |

(Continued)

OTHER PUBLICATIONS

Intex, PureSpa SSP-10 Owner's Manual, dated Apr. 18, 2013, 17 pages.

(Continued)

*Primary Examiner* — Lori Baker
(74) *Attorney, Agent, or Firm* — Faegre Baker Daniels LLP

(57) ABSTRACT

An inflatable spa having improved strength. A control system may be provided with the inflatable spa to direct water and air into a water cavity of the inflatable spa, such that the water cavity of the inflatable spa may receive massaging air bubbles and/or jetted water from the control system.

30 Claims, 37 Drawing Sheets

(51) Int. Cl.

| | |
|---|---|
| ***A61H 33/00*** | (2006.01) |
| ***E04H 4/12*** | (2006.01) |
| ***E04H 4/00*** | (2006.01) |

(52) U.S. Cl.

CPC ..... *A61H 33/02* (2013.01); *A61H 33/6005* (2013.01); *A61H 33/6021* (2013.01); *A61H 33/6047* (2013.01); *A61H 33/6068* (2013.01); *E04H 4/0025* (2013.01); *E04H 4/129* (2013.01); *A61H 2033/023* (2013.01); *A61H 2201/0103* (2013.01); *A61H 2201/0157* (2013.01); *Y10T 29/49826* (2015.01)

(56) References Cited

U.S. PATENT DOCUMENTS

| | | | | |
|---|---|---|---|---|
| 1,331,018 | A | 2/1920 | Luthy | |
| 1,775,942 | A | 9/1930 | Millmather | |
| 2,549,597 | A | 4/1951 | Davis et al. | |
| 2,743,510 | A | 5/1956 | Mauney et al. | |
| 2,753,573 | A | 7/1956 | Barker | |
| 3,008,213 | A | 11/1961 | Foster et al. | |
| 3,092,101 | A * | 6/1963 | Kinney | A61H 33/6026 4/585 |
| 3,336,921 | A | 8/1967 | Lloyd | |
| 3,522,123 | A | 7/1970 | Marchant | |
| 3,573,151 | A | 3/1971 | Dawbarn | |
| 3,683,431 | A | 8/1972 | Pennel et al. | |
| 3,899,622 | A | 8/1975 | Geiger | |
| 4,295,918 | A | 10/1981 | Benson et al. | |
| 4,535,490 | A | 8/1985 | Wright | |
| 4,566,443 | A | 1/1986 | Bucher | |
| 4,754,502 | A | 7/1988 | Bowen | |
| 4,773,104 | A | 9/1988 | Want | |
| 4,843,659 | A | 7/1989 | Popovich et al. | |
| 4,899,401 | A | 2/1990 | Savarese | |
| 4,920,588 | A | 5/1990 | Watkins | |
| 4,981,543 | A | 1/1991 | Popovich et al. | |
| 5,083,361 | A | 1/1992 | Rudy | |
| 5,095,559 | A * | 3/1992 | Liljegren | A61H 33/025 219/201 |
| 5,101,823 | A | 4/1992 | Smith | |
| 5,135,440 | A | 8/1992 | Smollar et al. | |
| 5,249,323 | A | 10/1993 | Kikuchi et al. | |
| 5,283,915 | A | 2/1994 | Idland et al. | |
| 5,345,622 | A | 9/1994 | Plone | |
| 5,345,996 | A | 9/1994 | Druien | |
| 5,490,295 | A | 2/1996 | Boyd | |
| 5,567,127 | A | 10/1996 | Wentz | |
| 5,585,025 | A | 12/1996 | Idland | |
| D386,238 | S | 11/1997 | Peterson | |
| 5,718,007 | A | 2/1998 | Loyd | |
| 5,735,000 | A | 4/1998 | Pfaeffle | |
| 5,809,942 | A | 9/1998 | Kralovee et al. | |
| 5,865,564 | A | 2/1999 | Miller et al. | |
| 5,924,144 | A | 7/1999 | Peterson | |
| 5,985,071 | A | 11/1999 | Wynne et al. | |
| 6,003,166 | A * | 12/1999 | Hald | A61H 33/6026 137/563 |
| 6,108,829 | A | 8/2000 | Wadsworth | |
| 6,199,224 | B1 * | 3/2001 | Versland | A61H 33/02 4/541.1 |
| 6,209,150 | B1 | 4/2001 | Hsu et al. | |
| 6,322,870 | B1 | 11/2001 | Tsai | |
| 6,357,059 | B1 | 3/2002 | Lau | |
| 6,385,864 | B1 | 5/2002 | Sell, Jr. et al. | |
| 6,405,386 | B1 | 6/2002 | Chang | |
| 6,412,123 | B1 | 7/2002 | Lau | |
| 6,474,373 | B1 | 11/2002 | Sejnowski | |
| 6,543,068 | B1 * | 4/2003 | Penninger | A47K 3/06 4/585 |
| 6,543,962 | B2 | 4/2003 | Wells | |
| 6,571,405 | B1 | 6/2003 | Saputo et al. | |
| 6,859,953 | B1 | 3/2005 | Christensen | |
| 7,032,258 | B2 | 4/2006 | O'Hanlon | |
| 7,070,845 | B2 | 7/2006 | Thomas et al. | |
| 7,254,853 | B1 | 8/2007 | Kim | |
| 7,334,274 | B2 | 2/2008 | Wang | |
| 7,370,375 | B2 | 5/2008 | Phillips | |
| 7,461,416 | B2 | 12/2008 | Stover | |
| 7,467,496 | B1 | 12/2008 | Cuisset et al. | |
| 7,591,036 | B2 | 9/2009 | Lin et al. | |
| 7,694,372 | B1 | 4/2010 | Boyd | |
| 7,797,770 | B2 | 9/2010 | Lau | |
| 7,818,825 | B2 | 10/2010 | Lau | |
| 7,987,531 | B2 | 8/2011 | West | |
| 8,012,201 | B2 | 9/2011 | Lashinski et al. | |
| 8,095,998 | B2 | 1/2012 | Lau | |
| 8,108,954 | B2 | 2/2012 | Lau | |
| 8,562,773 | B2 | 10/2013 | Lin | |
| 2002/0020014 | A1 | 2/2002 | Authier et al. | |
| 2002/0029414 | A1 | 3/2002 | Shun Lau | |
| 2002/0053106 | A1 | 5/2002 | Turner | |
| 2004/0040083 | A1 | 3/2004 | Bentley | |
| 2005/0066433 | A1 | 3/2005 | Phillips | |
| 2005/0097777 | A1 | 5/2005 | Goodwin | |
| 2005/0235406 | A1 | 10/2005 | August | |
| 2006/0020332 | A1 | 1/2006 | Lashinski et al. | |
| 2006/0025854 | A1 | 2/2006 | Lashinski et al. | |
| 2006/0025855 | A1 | 2/2006 | Lashinski et al. | |
| 2006/0137087 | A1 | 6/2006 | Carreau et al. | |
| 2006/0260038 | A1 | 11/2006 | Lau | |
| 2007/0040368 | A1 | 2/2007 | Manley | |
| 2008/0141449 | A1 | 6/2008 | Ren | |
| 2008/0172783 | A1 | 7/2008 | Smith et al. | |
| 2009/0089924 | A1 | 4/2009 | Jan | |
| 2009/0241252 | A1 | 10/2009 | Li | |
| 2010/0107333 | A1 | 5/2010 | Ortlieb | |
| 2010/0325807 | A1 | 12/2010 | Wu | |
| 2011/0047691 | A1 | 3/2011 | Huang et al. | |
| 2011/0094025 | A1 | 4/2011 | West | |
| 2011/0219530 | A1 | 9/2011 | Hollaway | |
| 2012/0031265 | A1 | 2/2012 | Song et al. | |
| 2012/0124732 | A1 | 5/2012 | Lau | |
| 2012/0124734 | A1 | 5/2012 | Lau | |
| 2012/0297530 | A1 | 11/2012 | Huang | |
| 2013/0230671 | A1 | 9/2013 | Lin et al. | |

FOREIGN PATENT DOCUMENTS

| | | |
|---|---|---|
| CN | 2064797 | 10/1990 |
| CN | 2074591 | 4/1991 |
| CN | 2287948 | 8/1998 |
| CN | 2361179 | 2/2000 |
| CN | 1280467 | 1/2001 |
| CN | 1124804 | 10/2003 |
| CN | 1506140 | 6/2004 |
| CN | 2659261 | 12/2004 |
| CN | 2676755 | 2/2005 |
| CN | 2706070 | 6/2005 |
| CN | 2776171 | 5/2006 |
| CN | 1867280 | 11/2006 |
| CN | 2908147 | 6/2007 |
| CN | 2930467 | 8/2007 |
| CN | 201032956 | 3/2008 |
| CN | 201169931 | 12/2008 |
| CN | 101628698 | 1/2010 |
| CN | 101817233 | 9/2010 |
| CN | 201790383 | 4/2011 |
| CN | 202151339 | 2/2012 |
| CN | 202267222 | 6/2012 |
| CN | 203619151 | 6/2014 |
| DE | 20317936 | 2/2004 |
| DE | 202004000700 | 6/2004 |
| DE | 202004002168 | 3/2005 |
| DE | 102006053666 | 5/2008 |
| EP | 0152536 | 8/1985 |
| EP | 0678263 | 10/1995 |
| EP | 1138307 | 10/2001 |
| FR | 2979809 | 3/2013 |
| GB | 313023 | 6/1929 |
| GB | 410502 | 5/1934 |
| GB | 1380153 | 1/1975 |
| JP | 60-55904 | 4/1985 |

(56) References Cited

FOREIGN PATENT DOCUMENTS

| | | |
|---|---|---|
| JP | 7327782 | 12/1995 |
| JP | 2006527017 | 11/2006 |
| JP | 2007506529 | 3/2007 |
| SU | 410502 | 5/1934 |
| WO | 2004108047 | 12/2004 |
| WO | 2005030005 | 4/2005 |
| WO | 2013020464 | 2/2013 |
| WO | 2013034864 | 3/2013 |

OTHER PUBLICATIONS

Intex, PureSpa SPJ-HS-20 Owner's Manual, dated Dec. 20, 2013, 27 pages.
Intex, PureSpa Catalogue, dated Mar. 1, 2013, 2 pages.
Intex Recreaction Corp., Ultra Frame Pool, Enjoy the Ultimate Stay-cation!, poster, 2009, 1 page.
Intex Recreaction Corp., Easy Set Pool, packaging panel, Aug. 20, 2008, 1 page.
Intex Recreaction Corp., Pure Spa by Intex, packaging panels, 2013, 8 pages.
Translation of Chinese Utility Model CN 202151339 U, Vertical Air Compartment, Feb. 29, 2012, 5 pages.
International Search Report and Written Opinion in PCT/US2014/047252, issued Jan. 14, 2015, 16 pages.
UK Intellectual Property Office, Combined Search and Examination Report in GB1421648.5, issued Jan. 16, 2015, 2 pages.
Search Report dated Nov. 8, 2013 in corresponding European Application No. 13167369.
Search Report dated Nov. 8, 2013 in corresponding European Application No. 13167364.
Search Report dated Nov. 7, 2013 in corresponding European Application No. 13001945.
Hydro-Solutions, Inc. WIPP System Product Specification; pp. 1-12, Waller, Texas; www.wippsystems.com, 2006.
Third-Party Submission dated Jan. 5, 2014 in U.S. Appl. No. 14/444,337.
Search Report dated Feb. 3, 2015 in corresponding European Application No. 13167366.7.
Search Report dated Feb. 3, 2015 in corresponding European Application No. 13001948.2.
Search Report dated Feb. 3, 2015 in corresponding European Application No. 13001944.1.
Search Report dated Feb. 3, 2015 in corresponding European Application No. 13001947.4.
Search Report dated Feb. 3, 2015 in corresponding European Application No. 13001946.6.
Search Report dated Sep. 19, 2014 in corresponding European Application No. 12839169.5.
International Search Report dated Mar. 11, 2015 in PCT International Application No. PCT/US14/68884.
International Search Report dated Oct. 18, 2012 in PCT/US2012/042079.
Examination Decision on the Request for Invalidation dated May 4, 2015 in Chinese Application No. 201320796506.9.
Communication dated Dec. 23, 2015 in corresponding European Application No. 1300946.6.

* cited by examiner

INFLATABLE SPA

CROSS REFERENCE TO RELATED APPLICATIONS

This application is a continuation of U.S. application Ser. No. 14/444,474, filed Jul. 28, 2014, International Application No. PCT/US2014/47252, filed Jul. 18, 2014, and International Application No. PCT/US14/68884, filed Dec. 5, 2014, the disclosures of which are hereby expressly incorporated by reference herein in their entirety.

This application also claims priority to the following foreign patent applications under 35 U.S.C. §119(b), the disclosures of which are hereby expressly incorporated by reference herein in their entirety:

| Foreign Application Number | Filing Date |
|---|---|
| CN 2013-20428910.0 | Jul. 18, 2013 |
| CN 2013-20745798.3 | Nov. 21, 2013 |
| CN 2013-20745863.2 | Nov. 21, 2013 |
| CN 2013-20745887.8 | Nov. 21, 2013 |
| CN 2013-20746974.5 | Nov. 21, 2013 |
| CN 2013-20796506.9 | Dec. 5, 2013 |
| CN 2013-20888403.5 | Dec. 30, 2013 |
| CN 2013-20888639.9 | Dec. 30, 2013 |
| CN 2013-20892855.0 | Dec. 30, 2013 |
| CN 2014-10017358.5 | Jan. 15, 2014 |
| CN 2014-20023673.4 | Jan. 15, 2014 |
| CN 2014-20050705.X | Jan. 26, 2014 |
| CN 2014-20375437.9 | Jul. 8, 2014 |
| NL 2013918 | Dec. 4, 2014 |

FIELD OF THE DISCLOSURE

The present disclosure relates to an inflatable pool or spa. More particularly, the present disclosure relates to an inflatable pool or spa having improved strength, and to a method for using the same.

BACKGROUND AND SUMMARY

The inflatable pool or spa of the present disclosure is convenient to carry and consumers love it.

Known inflatable pools are commonly made from a PVC air chamber. Because of good flexibility and low rigidity of PVC cloth, the strength of the pool is often not enough, the shape can be easily changed after inflating, bumps can be present under low pressure, and the comfort of the product is affected.

Inflatable pools or spas are generally constructed of material having high flexibility and low rigidity. Although such inflatable spas are generally more affordable than permanent spas, inflatable spas generally lack the strength, comfort, clean appearance, and useful life of permanent spas. Also, inflatable spas may be difficult to assemble, dissemble, store, and transport.

The present disclosure relates to an inflatable pool or spa having improved strength. A water cavity of the inflatable pool may receive massaging air bubbles and/or jetted water so as to create a spa pool.

According to an embodiment of the present disclosure, an inflatable product is provided including a porous sheet coupled to a wall of the inflatable product.

According to another embodiment of the present disclosure, an inflatable product is provided including a porous sheet coupled to a wall of the inflatable product via an attachment sheet.

According to yet another embodiment of the present disclosure, an inflatable product is provided including a porous tensioning structure in an air chamber of the inflatable product.

According to still yet another embodiment of the present disclosure, an inflatable product is provided including a first wall, a second wall, an inflatable air chamber defined by the first wall and the second wall, and a plurality of tensioning structures located in the air chamber and coupled to the first wall and the second wall. Each tensioning structure includes at least one attachment sheet having an outer perimeter and a porous sheet coupled to the at least one attachment sheet, the porous sheet including a plurality of enclosed pores located entirely within the outer perimeter of the at least one attachment sheet.

In certain embodiments, the porous sheet includes a plurality of frame members that intersect to define the plurality of enclosed pores.

In certain embodiments, the plurality of frame members of the porous sheet are interwoven.

In certain embodiments, the plurality of frame members of the porous sheet are arranged in a grid pattern.

In certain embodiments, the porous sheet includes a plurality of open spaces that are partially surrounded by the frame members.

In certain embodiments the at least one attachment sheet has a lower melting point than the porous sheet.

In certain embodiments, the at least one attachment sheet, the first wall, and the second wall have similar melting points.

In certain embodiments, the porous sheet includes a second plurality of enclosed pores located beyond the outer perimeter of the at least one attachment sheet.

In certain embodiments, the porous sheet has an outer perimeter that substantially overlaps the outer perimeter of the at least one attachment sheet.

In certain embodiments, the product is a spa. In other embodiments, the product is a mattress. In other embodiments, the product is a pool.

In certain embodiments, the first wall is an internal wall of the pool or spa, and the second wall is an external wall of the pool or spa, the pool or spa further including a bottom wall that cooperates with the internal wall to define a water cavity.

In certain embodiments, the spa includes a water cavity, the product further including a heating unit in fluid communication with the water cavity, the heating unit including a heating element and a U-shaped water cavity around the heating element.

In certain embodiments, the product further includes a control system with a controller that maintains a current of the control system below a predetermined level by limiting a power supply to the heating unit.

According to still yet another embodiment of the present disclosure, an inflatable product is provided including a first wall, a second wall, an inflatable air chamber defined by the first wall and the second wall, and a plurality of tensioning structures located in the air chamber. Each tensioning structure is coupled to the first wall along a first seam that extends along a first line and to the second wall along a second seam that extends along a second line. Each tensioning structure includes a porous sheet with a plurality of pores, wherein any line parallel to the first line intersects the plurality of pores in the porous sheet.

In certain embodiments, the porous sheet includes a plurality of frame members that cooperate to define the plurality of pores, wherein the plurality of frame members are oriented transverse to the first line.

In certain embodiments, the plurality of frame members are oriented transverse to a third line that is perpendicular to the first line.

In certain embodiments, the first line is parallel to the second line.

According to still yet another embodiment of the present disclosure, an inflatable spa is provided including a top wall, a bottom wall, an internal wall, an external wall, an inflatable air chamber defined by the top wall, the bottom wall, the internal wall, and the external wall, a water cavity defined by the bottom wall and the internal wall, and a control system including an air pump operable in an inflation mode that supplies air to the air chamber to inflate the air chamber, a deflation mode that removes air from the air chamber to deflate the air chamber, and an aeration mode that supplies air to the water cavity to aerate the water cavity.

In certain embodiments, the spa further includes an air passageway between the air pump and the spa that extends above the water cavity of the spa.

In certain embodiments, the control system further includes a control panel assembly that receives a user input, wherein the control panel assembly is mounted to the air passageway at a location above the water cavity of the spa.

In certain embodiments, the air passageway includes a first check valve and a second check valve positioned in series to prevent a backflow of water from the water cavity of the spa to the air pump.

In certain embodiments, at least one of the first check valve and the second check valve becomes progressively tighter as water pressure from the water cavity of the spa increases.

According to still yet another embodiment of the present disclosure, an inflatable spa is provided including a top wall, a bottom wall, an internal wall, an external wall, an inflatable air chamber defined by the top wall, the bottom wall, the internal wall, and the external wall, a water cavity defined by the bottom wall and the internal wall, and a jetted water pipe network that delivers jetted water to the water cavity, wherein the jetted water pipe network is substantially concealed within the inflatable air chamber.

In certain embodiments, the spa further includes a control system and a single water inlet pipe between the water cavity and the control system, wherein the water inlet pipe includes a filtered water inlet portion and a jetted water inlet portion.

In certain embodiments, the control system includes a drain assembly having a filtered water drain passageway in fluid communication with the filtered water inlet portion of the water inlet pipe, a jetted water drain passageway in fluid communication with the jetted water inlet portion of the water inlet pipe, and an outlet in fluid communication with both the filtered water drain passageway and the jetted water drain passageway.

In certain embodiments, the spa further includes a filtering cover that covers both the filtered water inlet portion and the jetted water inlet portion of the water inlet pipe.

In certain embodiments, the jetted water pipe network includes a plurality of spray nozzles, a first connecting pipe that delivers water to the plurality of spray nozzles, and a second connecting pipe that delivers air to the plurality of spray nozzles, wherein the plurality of spray nozzles, the first connecting pipe, and the second connecting pipe are substantially concealed within the inflatable air chamber.

In certain embodiments, the first and second connecting pipes are flexible.

In certain embodiments, the plurality of spray nozzles are spaced apart annularly about the internal wall of the spa.

According to still yet another embodiment of the present disclosure, a method is provided for erecting an inflatable spa having an inflatable air chamber and a water cavity. The method includes inflating the air chamber of the inflatable spa to a pressure greater than about 0.8 psi. In certain embodiments, the pressure is about 1.5 psi.

According to still yet another embodiment of the present disclosure, a method is provided for manufacturing an inflatable product having an air chamber defined by a plurality of walls. The method includes providing a porous sheet of a first material, at least a portion of the first material surrounding a plurality of pores in the porous sheet, placing the porous sheet between a second sheet of a second material and a third sheet of a third material, the second material and the third material covering the portion of the first material that surrounds the plurality of pores in the porous sheet, attaching the second sheet to the third sheet, and placing the porous sheet in the air chamber of the inflatable product.

In certain embodiments, the second sheet includes an attachment layer located between one of the plurality of walls of the inflatable product and the porous layer.

In certain embodiments, the second sheet includes one of the plurality of walls of the inflatable product.

In certain embodiments, the attaching step includes attaching the second material of the second sheet to the third material of the third sheet through the plurality of pores in the porous sheet.

In certain embodiments, the attaching step includes melting the second material of the second sheet and the third material of the third sheet.

In certain embodiments, the second material of the second sheet is the same as the third material of the third sheet.

According to still yet another embodiment of the present disclosure, an inflatable pool is provided including a top wall; a bottom wall; an inner side wall; and an outer side wall, wherein the outer side wall surrounds the inner side wall; and wherein the top wall is connected to the top of the inner side wall and the top of the outer side wall, the bottom wall is connected to the bottom of the inner side wall and the bottom of the outer side wall, and an inflatable air chamber is defined by the top wall, the bottom wall, the inner side wall and the outer side wall; and wherein, the pool also comprises a plurality of laminated elements arranged in the air chamber in an annular array manner and connected to the inner side wall and the outer side wall, and wherein the laminated elements each comprise a first layer of a pattern of crossed fibers and an attaching layer to which the first layer is attached.

Certain preferred or alternative embodiments of the invention are defined in the dependent claims to which reference should now be made.

BRIEF DESCRIPTION OF THE DRAWINGS

The above-mentioned and other features and advantages of this disclosure, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION

1. Spa Construction

Figure 3:
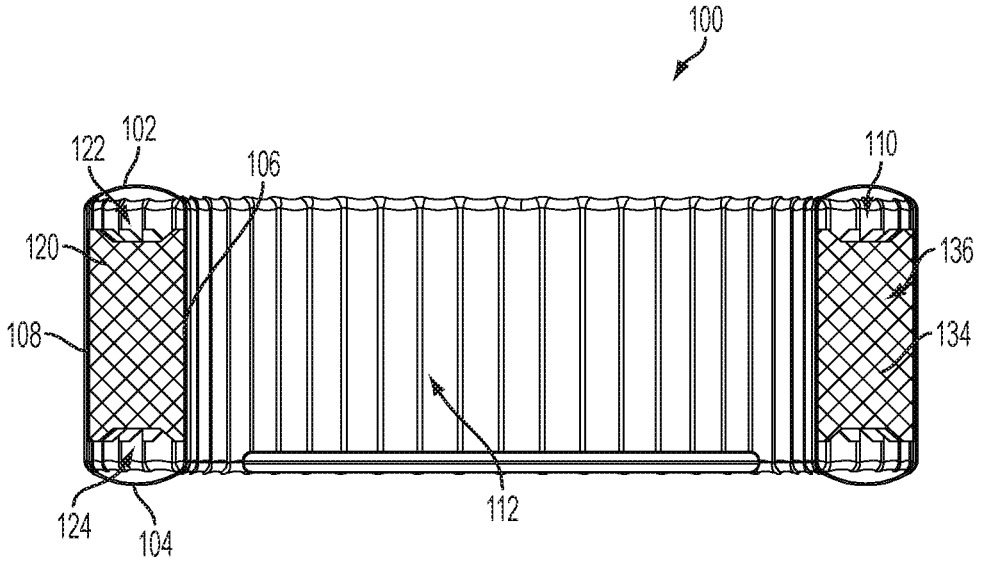
FIG. 3 is a side cross-sectional view of the inflatable product of FIG. 1.

The term "top", "bottom" and "side" and other terms used to describe relative positions of components of pools or spas according to the invention refer to the pool or spa in its upright inflated position and defining a water cavity (as shown in, for example, FIG. 3). The terms pool and spa are used interchangeably in the following description with a spa being a particular type of pool which may include a supply of aerated water.

With the following description of the drawings and specific embodiment, the invention shall be further described in details.

Figure 1:
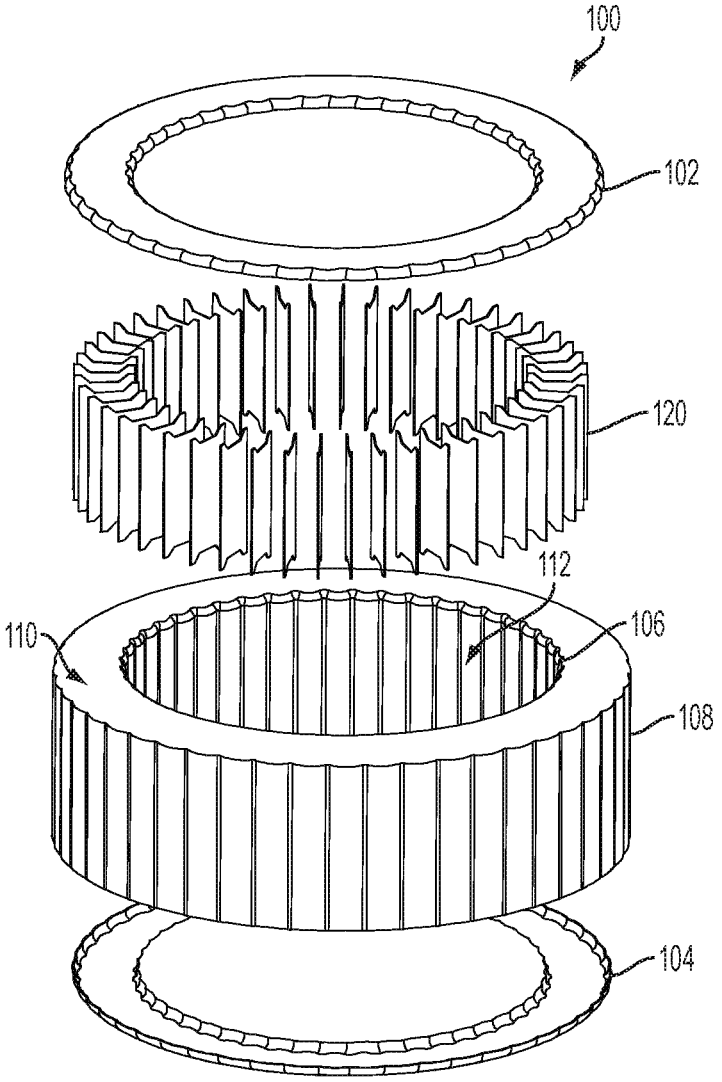
FIG. 1 is an exploded perspective view of an exemplary inflatable pool or spa of the present disclosure, the inflatable pool or spa including a plurality of tensioning structures.
Figure 2:
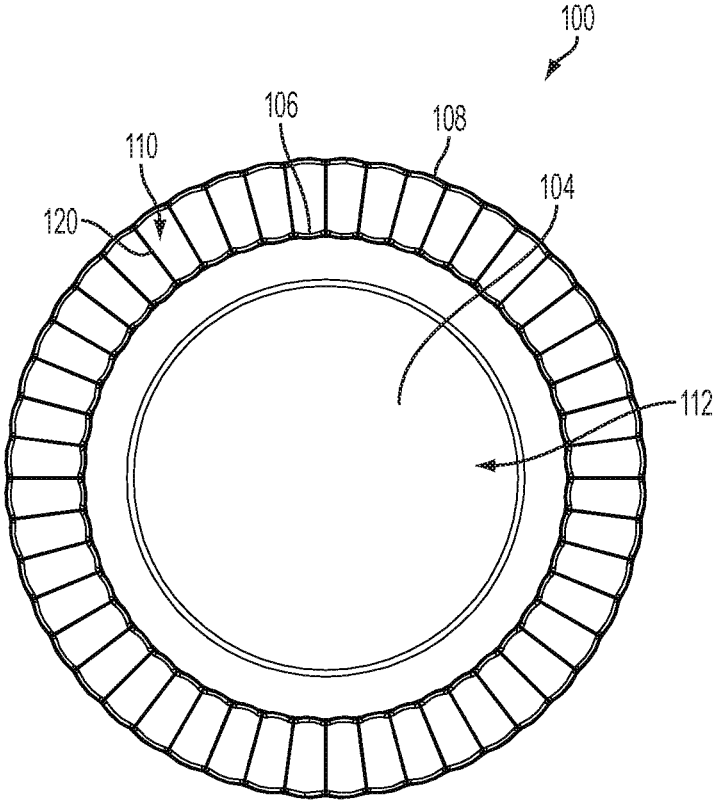
FIG. 2 is a top cross-sectional view of the inflatable product of FIG. 1.

According to FIGS. 1, 2 and 3, the inflatable pool 100 in the present invention comprises top wall or panel 10, bottom wall or panel 20, inner surrounding or side wall 106, outer surrounding or side wall 108 and a plurality of laminated interval or bracing elements 120. The interval or bracing elements 120 may also be walls or panels.

The diameter of the outer side wall 108 is longer than that of the inner side wall 106, and the outer side wall 108 is sleeved out of the inner side wall 106, and a circular trough structure. The outer side wall 108 surrounds and may be substantially concentric with the inner side wall 106.

The top wall 102 is annular, and is connected to the top of the inner side wall 106 and the outer side wall 108.

The bottom wall 104 is connected to the bottom of the inner side wall 106 and the outer wall 108. An air chamber 110 is generated by the top wall 102, the bottom wall 104, the inner or internal wall 106 and the outer or external wall 108.

The laminated walls 120 are vertically arranged in the air chamber 110 in an annular array manner, and are connected to the inner wall 106 and the outer wall 108 through suitable coupling techniques, such as high-frequency coupling (or welding), hot coupling (e.g. melting or welding), or adhering (e.g. gluing), for example. An interval 122 is formed between the top of the laminated elements 120 and the top wall 102. A gap 124 is formed between the bottom of the laminated elements 120 and the bottom wall 104.

Figure 4:
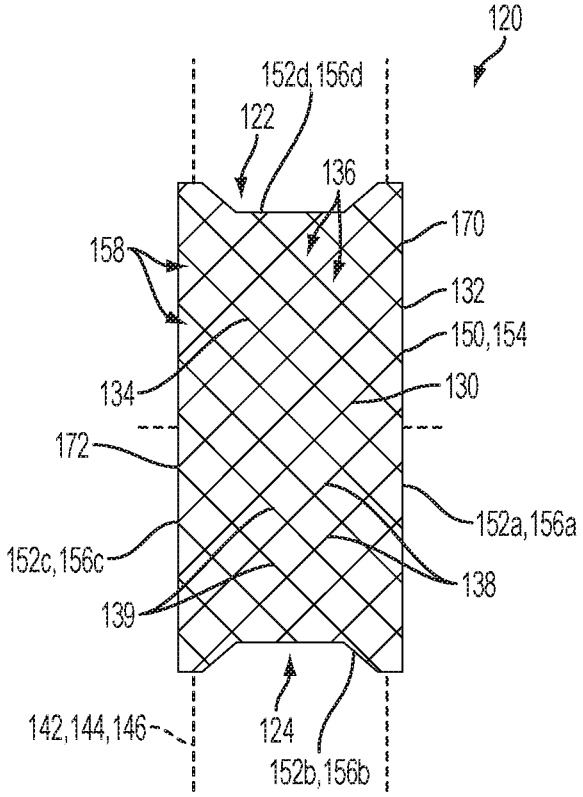
FIG. 4 is an elevational view of the tensioning structure of FIG. 1.
Figure 5:
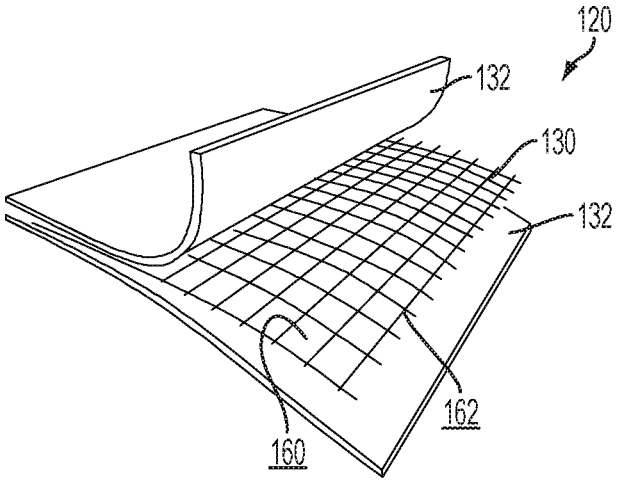
FIG. 5 is an exploded perspective view of the tensioning structure including a porous layer and two attachment layers.

According to FIG. 4 and FIG. 5, the laminated wall 120 comprises a pattern or screen layer 130 formed by a porous open pattern of crossed or interwoven yarns or fibers (e.g. a cloth or textile having an open weave) and two attaching layers 132. The two attaching layers 132 are attached to the upper and lower surface of the first layer 130 respectively to hold the first layer 130. The attaching layer or layers 132 can be made of PVC (polyvinyl chloride), TPR (thermoplastic rubber), EVA (ethylene vinyl acetate) or cloth.

Figure 6:
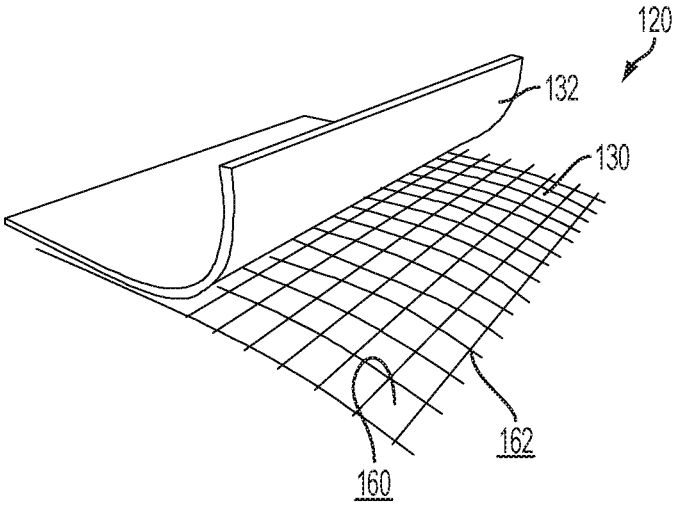
FIG. 6 is an exploded perspective view of the tensioning structure including a porous layer and an attachment layer.

According to FIG. 6, the laminated layer 120 can also comprise one attaching layer 132, and the pattern layer 130 is attached to the attaching layer 132.

Figure 7:
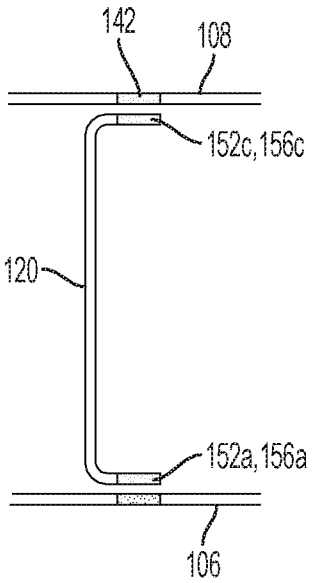
FIG. 7 is a top cross-sectional view of the tensioning structure coupled directly to the inflatable product.

According to FIG. 7, the laminated layer 120, the outer wall 108 and the inner wall 106 can be connected through suitable coupling techniques, such as high-frequency coupling (or welding), hot coupling (e.g. melting or welding), or adhering (e.g. gluing), for example.

Figure 8:
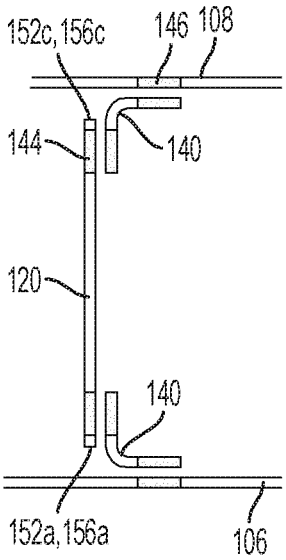
FIG. 8 is a top cross-sectional view of the tensioning structure coupled indirectly to the inflatable product via intermediate connecting layers.

According to FIG. 8, the laminated interval wall 120, the outer wall 108 and the inner wall 106 can be connected by a connecting element, strip, wall or panel in a transition manner, namely the laminated element 120 is connected to the connecting element 90 through, for example, high-frequency coupling (or welding), hot coupling (e.g. melting or welding), or adhering (e.g. gluing), then the connecting element 90 is connected to the inner wall 106 and the outer wall 108 through high-frequency coupling (or welding), hot coupling (e.g. melting or welding), or adhering (e.g. gluing).

Now describing the embodiments shown in the figures in more detail and referring initially to FIGS. 1-3, an inflatable pool or spa 100 is shown including a top wall 102, a bottom wall 104, an internal or inner wall 106, and an external or outer wall 108. The top wall 102 is an annular wall and is connected to the top ends of both the internal wall 106 and the external wall 108. The bottom wall 104 is also an annular wall and is connected to the bottom ends of both the internal wall 106 and the external wall 108. The diameter of the external wall 108 is larger than the diameter of the internal wall 106. The top wall 102, the bottom wall 104, the internal wall 106, and the external wall 108 of the spa or pool may be constructed of polyvinyl chloride (PVC), thermoplastic rubber (TPR), ethylene vinyl acetate (EVA), thermoplastic polyurethane elastomer (TPU), or other suitable materials.

The spa or pool 100 includes an inflatable air chamber 110 formed between the top wall 102, the bottom wall 104, the internal wall 106, and the external wall 108. The air chamber 110 includes one or more suitable air vents (not shown) for inflating and deflating the air chamber 110. In certain embodiments, the air chamber 110 may be inflated to a relatively high pressure greater than about 0.8 psi. For example, the air chamber 110 may be inflated to a pressure of about 0.9 psi, 1.0 psi, 1.1 psi, 1.2 psi, 1.3 psi, 1.4 psi, 1.5 psi, 1.6 psi, or more. Such pressures may be about 1.5 or 2 times greater than pressures used to inflate traditional inflatable products.

Figure 9:
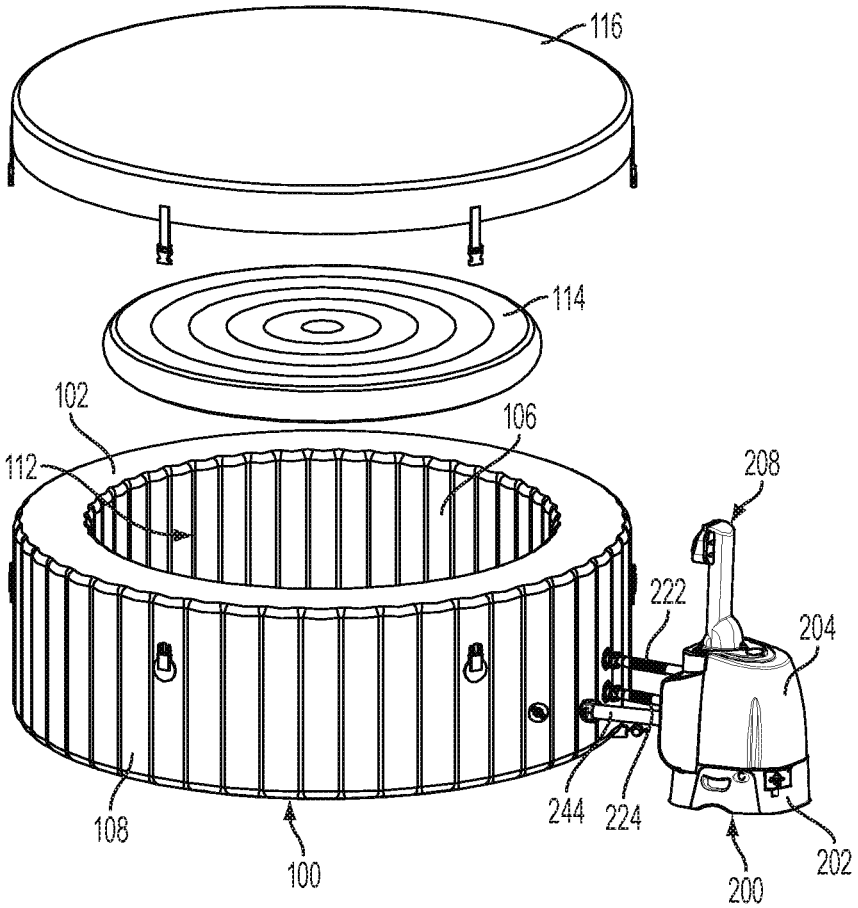
FIG. 9 is an exploded perspective view of an inflatable spa shown coupled to an exemplary control system of the present disclosure for supplying bubbles to the inflatable spa.

The spa pool 100 also includes a water cavity 112 formed by the bottom wall 104 and the internal wall 106. One or more covers, such as a sealing cover 114 and a dust cover 116 above the sealing cover 114, may be provided to cover the water cavity 112 when spa 100 is not in use, as shown in FIG. 9.

Inside the air chamber 110, the pool 100 also includes a plurality of internal tensioning, interval or bracing elements or structures 120 that maintain the shape of the pool 100 when the air chamber 110 is pressurized. The tensioning structures 120 may enhance the strength of the pool 100, allowing the air chamber 110 to withstand relatively high internal pressures, as discussed above, while also providing comfort a user sitting on or in pool or spa 100.

As shown in FIGS. 1 and 2, the tensioning structures 120 are arranged vertically and radially in the air chamber 110 in an annular array pattern. As shown in FIG. 3, each tensioning structure 120 may be coupled to the internal wall 106 and the external wall 108, as discussed further below with reference to FIGS. 7 and 8. Also, each tensioning structure 120 may be spaced apart from top wall 102 and the bottom wall 104 to define an upper gap 122 relative to the top wall 102 and a lower gap 124 relative to the bottom wall 104.

Referring next to FIGS. 4-6, each tensioning structure 120 may include a porous layer or sheet 130 and one or more attachment layers or sheets 132 attached (e.g., laminated) to the porous layer 130. In the illustrated embodiment of FIG. 5, the porous layer 130 is sandwiched between two attachment layers 132, with the attachment layers 132 being attached to both the upper surface 160 and the lower surface 162 of the porous layer 130. In the illustrated embodiment of FIG. 6, the porous layer 130 is attached to a single attachment layer 132, with the single attachment layer 132 being attached to either the upper surface 160 or the lower surface 162 of the porous layer 130.

Except for the upper gap 122 and the lower gap 124 in the tensioning structure 120, the tensioning structure 120 may be generally rectangular in shape, as shown in FIG. 4. In this embodiment, the porous layer 130 includes a generally rectangular outer perimeter 150 formed by edges 152*a-d*, and the attachment layer 132 includes a generally rectangular outer perimeter 154 formed by edges 156*a-d*. The attachment layer 132 may span across the entire porous layer 130, as shown in FIG. 4, such that the outer perimeter 154 of the attachment layer 132 generally overlaps the outer perimeter 150 of the porous layer 130. It is also within the scope of the present disclosure that the attachment layer 132 may span across a portion of the porous layer 130.

The porous layer 130 may be formed from a plurality of ligaments or frame members 134 that define a plurality of holes or pores 136 therebetween, as shown in FIG. 4. When the air chamber 110 is pressurized, frame members 134 may be placed in tension to help maintain the shape of spa 100. Adjacent frame members 134 may be spaced apart at regular intervals to provide the tensioning structure 120 with a substantially constant tensile strength.

Each pore 136 of the porous layer 130 may be enclosed or entirely surrounded by intersecting frame members 134 over a 360 degree range. A plurality of pores 136 may be located entirely within the outer perimeter 154 of the attachment layer 132 to facilitate attachment to the attachment layer 132, as discussed further below. It is also within the scope of the present disclosure that other pores 136 may be located outside of the outer perimeter 154 of the attachment layer 132. The size and shape of each pore 136 may vary depending on the thickness and orientation of the surrounding frame members 134. The porous layer 130 may also include a plurality of open spaces 158 that are partially surrounded by frame members 134 and partially exposed along the outer perimeter 150, for example.

In the illustrated embodiment of FIG. 4, the frame members 134 are arranged in a grid pattern, including a first set of spaced-apart and parallel frame members 138 and a second set of spaced-apart and parallel frame members 139. In this grid pattern, the first set of frame members 138 is transverse to the second set of frame members 139 such that the first set of frame members 138 intersects the second set of frame members 139. In FIG. 4, the grid pattern is rotated by about 45 degrees from a horizontal axis to resemble a lattice, such that the first set of frame members 138 are angled upward from the horizontal axis (e.g., about +45 degrees from the horizontal axis), and the second set of frame members 139 are angled downward from the horizontal axis (e.g., about −45 degrees from the horizontal axis) and substantially perpendicular to the first set of frame members 138. Between adjacent frame members 134, evenly spaced, diamond-shaped pores 136 are formed in FIG. 4. Adjacent pores 136 may also be angled upward and downward relative to the horizontal axis.

According to an exemplary embodiment of the present disclosure, the porous, pattern or screen layer 130 may be constructed of a mesh, cloth, or screen having interwoven strings, fibers, or wires as individual frame members 134. Certain embodiments use fibers of a polyester, nylon or cotton. As shown in FIG. 4, each frame member 134 may include a first terminal end 170 located at an edge (e.g., edge 152*a*) of the porous layer 130 and a second terminal end 172 located at an opposing edge (e.g., edge 152*c*) of the porous layer 130.

As discussed above, each tensioning structure 120 may be coupled to the internal wall 106 and the external wall 108 using suitable coupling techniques, such as high-frequency coupling, hot coupling (e.g., melting, welding), or adhering (e.g., gluing), for example. In the illustrated embodiment of FIG. 7, the tensioning structure 120 is directly coupled to the internal wall 106 and the external wall 108 along a seam 142. In the illustrated embodiment of FIG. 8, the tensioning structure 120 is indirectly coupled to the internal wall 106 and the external wall 108 using intermediate connecting layers 140. More specifically, the tensioning structure 120 is coupled to the intermediate connecting layers 140 via a first seam 144, and the intermediate connecting layers 140 are coupled to the internal wall 106 and the external wall 108 via a second seam 146. As shown in FIGS. 7 and 8, the seams 142, 144, 146 may be located along opposing edges (e.g., edges 152*a*, 156*a* and edges 152*c*, 156*c*) of the tensioning structure 120. Returning to FIG. 4, the seams 142, 144, 146 are shown extending in a vertical direction along the right-side edges 152*a*, 156*a*, of the tensioning structure 120 to attach the tensioning structure 120 to the adjacent internal wall 106 and along the left-side edges 152*c*, 156*c* of the tensioning structure 120 to attach the tensioning structure 120 to the adjacent external wall 108, for example.

According to an exemplary embodiment of the present disclosure, the frame members 134 are oriented transverse (i.e., not parallel) to the seams 142, 144, 146. In FIG. 4, the frame members 138 are angled side-to-side in the vertical direction. In this embodiment, as the vertical seams 142, 144, 146 and any line parallel to the vertical seams 142, 144, 146 passes through the tensioning structure 120, the vertical line will intersect at least one pore 136 or open space 158 between the frame members 134. In other words, there is no vertical line that will pass entirely through the tensioning structure 120 along a frame member 134 without intersecting at least one pore 136 or open space 158 adjacent to the frame member 134. In FIG. 4, the frame members 138 are also oriented transverse to any horizontal line that is perpendicular to the seams 142, 144, 146. As discussed above, the frame members 138 are angled upward and downward in the horizontal direction. In this embodiment, as any horizontal line perpendicular to the vertical seams 142, 144, 146 passes through the tensioning structure 120, the horizontal line will intersect at least one pore 136 or open space 158 between the frame members 134. In other words, there is no horizontal line that will pass entirely through the tensioning structure 120 along a frame member 134 without intersecting at least one pore 136 or open space 158 adjacent to the frame member 134.

To facilitate secure connections between the tensioning structure 120, the internal wall 106 of spa 100, the external wall 108 of spa 100, and the optional intermediate connecting layers 140, the materials used to construct these adjacent layers may be the same or otherwise compatible. For example, if the internal wall 106, the external wall 108, and the optional intermediate connecting layers 140 are constructed of PVC, TPR, EVA, or TPU, at least a portion of the corresponding tensioning structure 120 may also be constructed of PVC, TPR, EVA, or TPU. In embodiments where the adjacent layers are melted using high-frequency radiation, for example, the compatible materials may have the same or similar melting points to ensure that the materials melt, blend together, and form secure connections. According to an exemplary embodiment of the present disclosure, at least the attachment layer 132 of the tensioning structure 120 may be constructed of a compatible material. The porous layer 130 of the tensioning structure 120, by contrast, may be constructed of a different, potentially incompatible (e.g., higher melting), potentially stronger material, because the pores 136 in the porous layer 130 may accommodate bonding of adjacent compatible materials (e.g., one or more attachment layers 132, the internal wall 106 of spa 100, the external wall 108 of spa 100, and/or the optional intermediate connecting layers 140) through the pores 136 in the porous layer 130. For example, the attachment layer 132 of the tensioning structure 120 may be constructed of a compatible material such as PVC, TPR, EVA, or TPU, whereas the porous layer 130 of the tensioning structure 120 may be constructed of a cloth or screen.

It is also within the scope of the present disclosure that internal tensioning structures 120 may include a pair of plastic sheets connected together via a plurality of tensioning strands, such as strings or wires, as disclosed in U.S. Patent Application Publication No. US 2013/0230671, the disclosure of which is expressly incorporated herein by reference in its entirety.

It is also within the scope of the present disclosure that the tensioning structures 120 may be used in other inflatable products, such as inflatable mattresses and pools.

2. Bubble Embodiment

Figure 10:
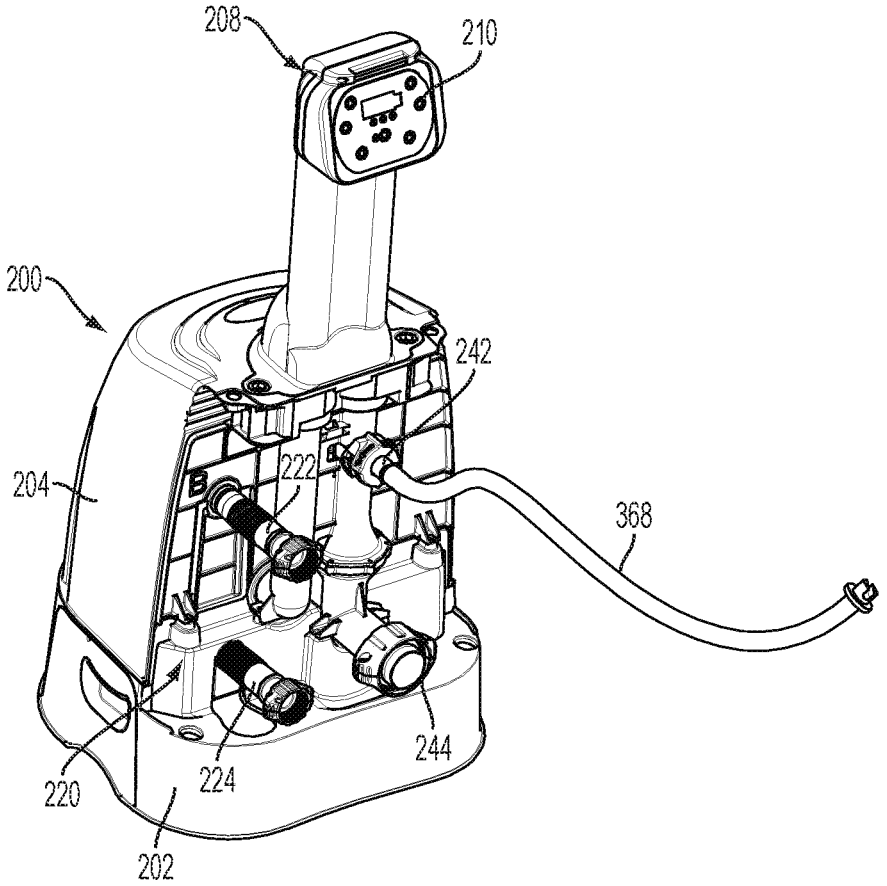
FIG. 10 is a perspective view of the control system of FIG. 9.
Figure 11:
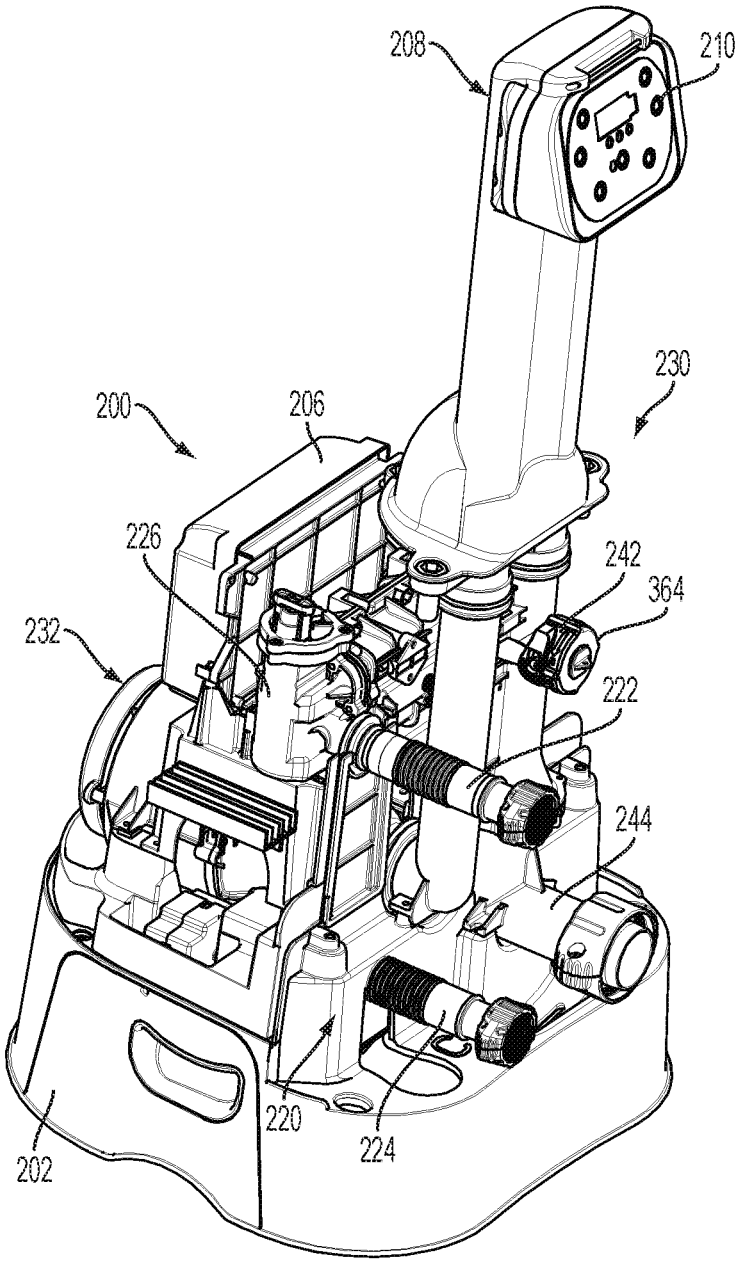
FIG. 11 is a perspective view of the control system of FIG. 10 with an outer shell removed.
Figure 12:
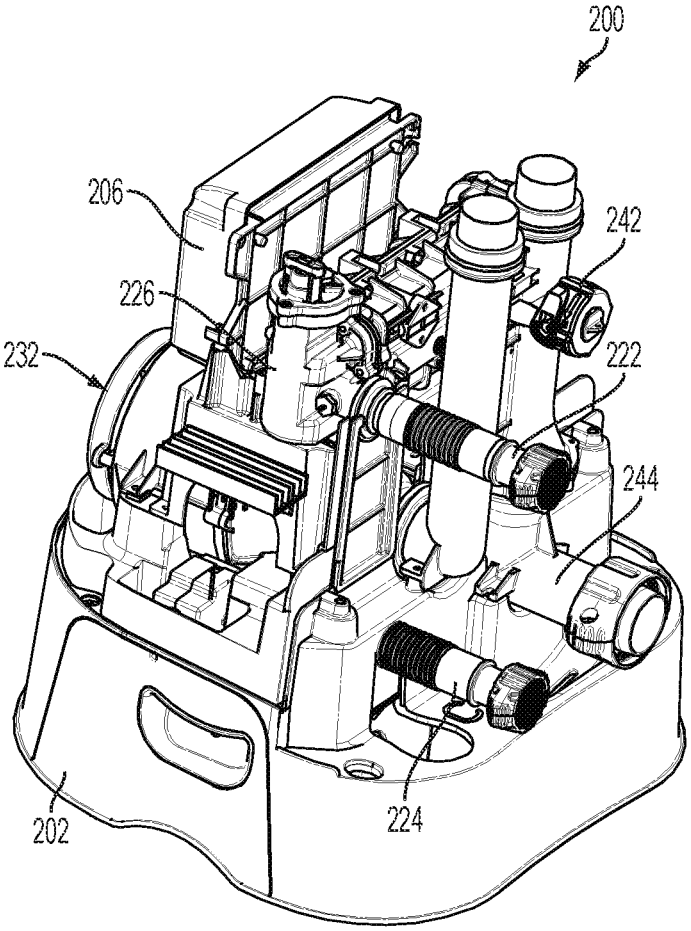
FIG. 12 is a perspective view of the control system of FIG. 11 with a control panel assembly removed.

Referring next to FIGS. 10-14, a first control system 200 is shown for use with spa 100. Control system 200 includes a base 202 and an outer shell 204 mounted to base 202. Control system 200 also includes a controller 206 and a control panel assembly 208 having a plurality of buttons 210, as shown in FIG. 11. In use, when a user inputs commands using buttons 210, control panel assembly 208 sends appropriate signals to controller 206, and controller 206 controls the operation of control system 200.

Control system 200 includes a water passageway 220 that extends between a water inlet pipe 222 from spa 100 and a water outlet or return pipe 224 to spa 100. Along the water passageway 220, control system 200 includes a filter pump (not shown) that pumps and filters water from spa 100 and a heating unit 226 that heats water from spa 100 before returning the water to spa 100, as shown in FIG. 11. It is also within the scope of the present disclosure that control system 200 may include a hard water treatment unit (not shown) and/or a salt water unit (not shown). The user may selectively activate and deactivate these units using buttons 210 on the control panel assembly 208. It is also within the scope of the present disclosure that some units may activate and deactivate automatically based on the status of another unit. For example, whenever the heating unit 226 is activated, the filter pump may activate automatically to pump water through the warmed heating unit 226. As another example, whenever the filter pump is activated, the hard water treatment unit may activate automatically to treat the filtered water.

Figure 13:
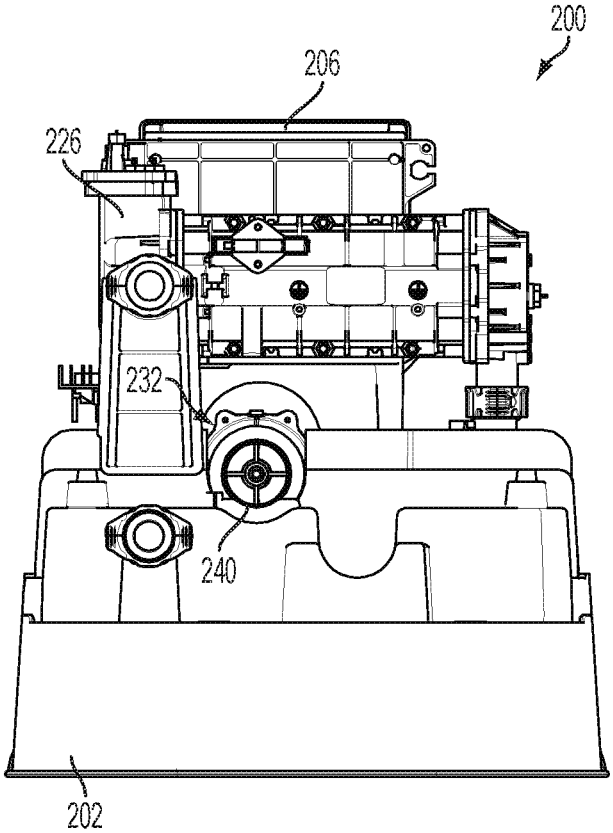
FIG. 13 is an elevational view of the control system of FIG. 12.
Figure 14:
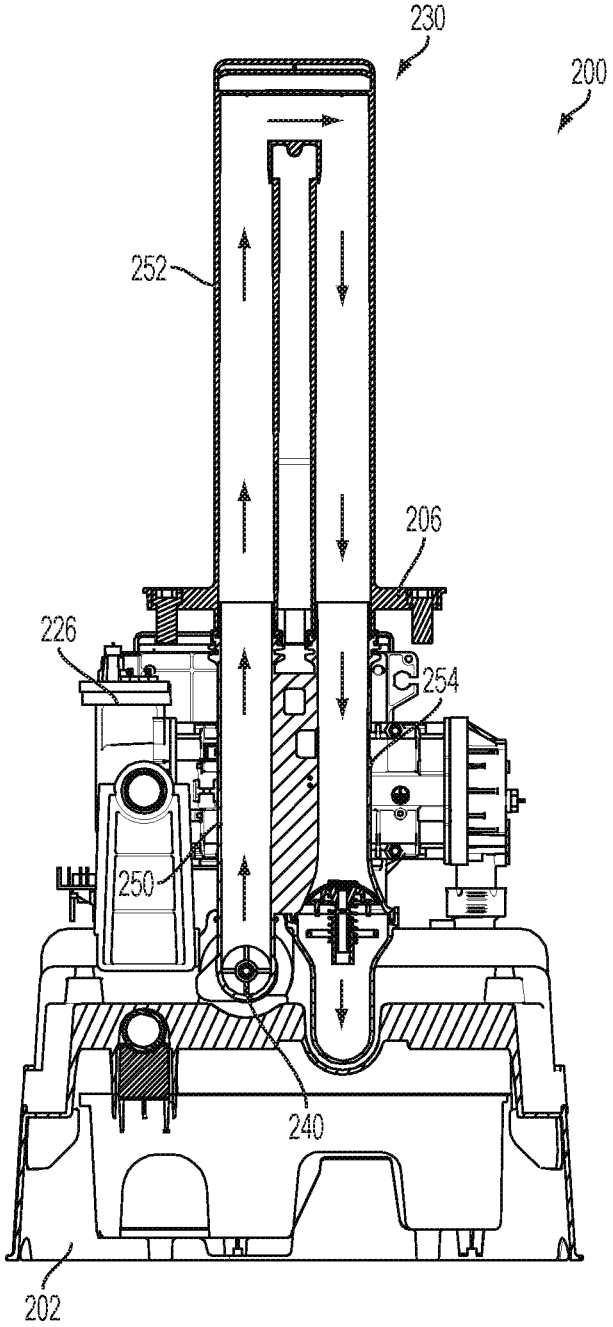
FIG. 14 is an elevational cross-sectional view of the control system of FIG. 11.
Figure 15:
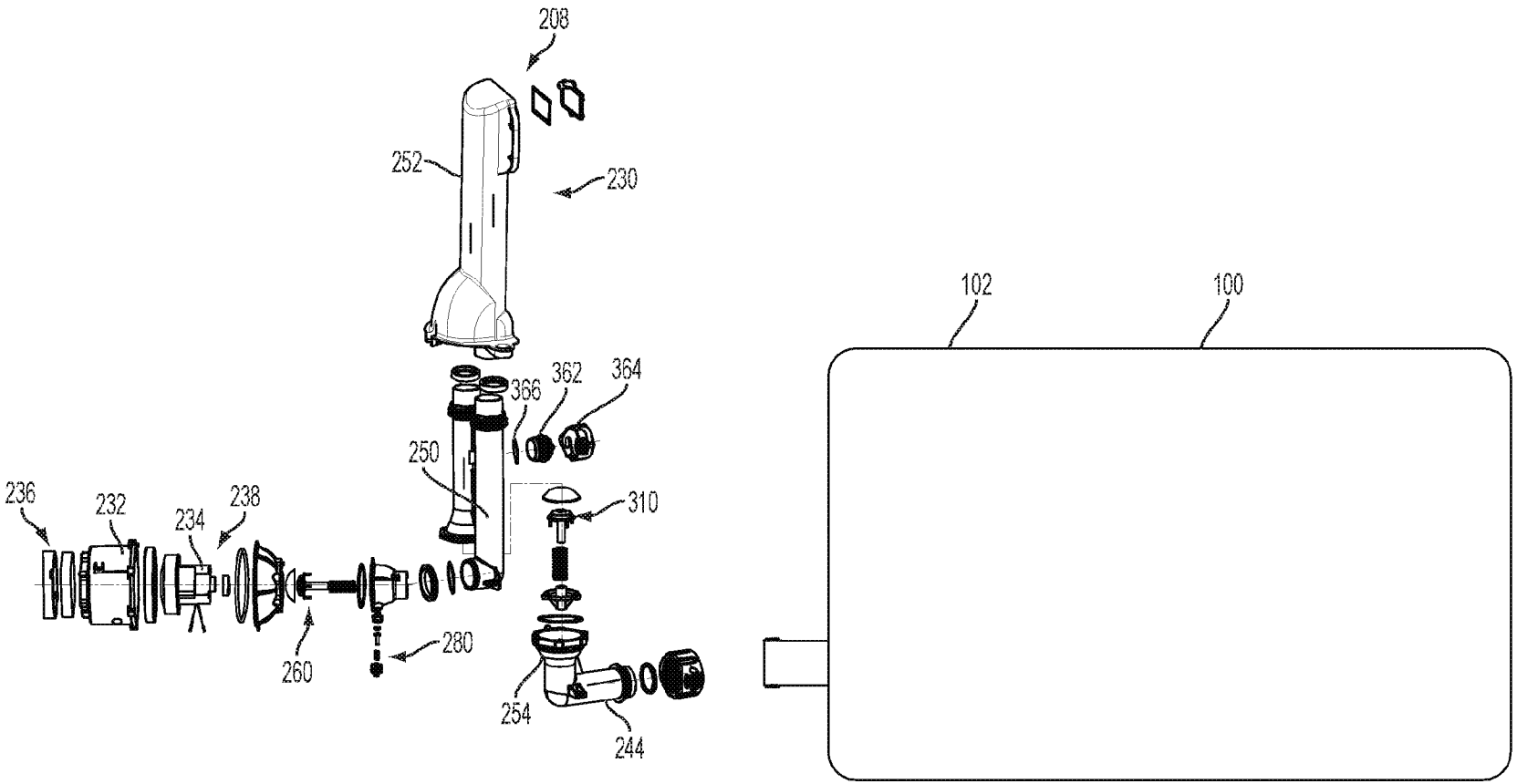
FIG. 15 is an exploded perspective view of an air passageway of the control system of FIG. 9, the air passageway including an air pump, a first check valve, a drain valve, and a second check valve.
Figure 16:
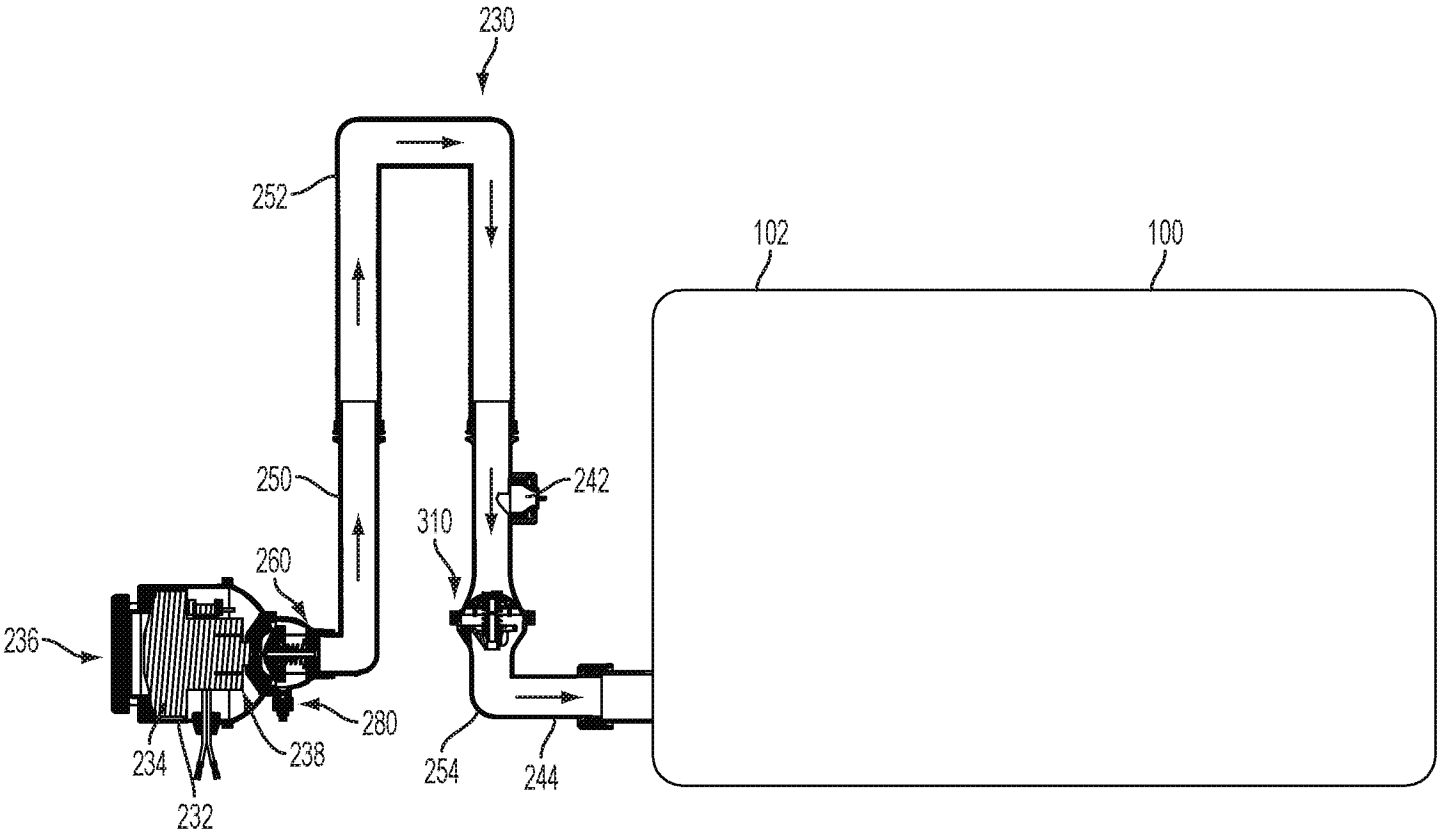
FIG. 16 is a cross-sectional view of the air passageway of FIG. 15.

Referring next to FIGS. 15 and 16, control system 200 also includes an air passageway 230. Along the air passageway 230, control system 200 includes an air pump 232 having an air generating assembly 234 with a suction side 236 and a pressurized discharge side 238. The discharge side 238 of the air pump 232 includes a delivery or way-making cavity 246 having an arcuate valve seat surface 248 around the delivery cavity 246. On the suction side 236 of the air pump 232, the air passageway 230 includes an air inlet pipe 240 (which may also be referred to herein as a deflation pipe) (FIG. 13). On the discharge side 238 of the air pump 232, the air passageway 230 includes a first air outlet pipe 242 (which may also be referred to herein as an inflation pipe) and a second air outlet pipe 244 (which may also be referred to herein as an aeration pipe).

Between the discharge side 238 of the air pump 232 and spa 100, the illustrative air passageway 230 includes a first pipe portion 250 that communicates with the discharge side 238 of the air pump 232, a second pipe portion 252 that follows the first pipe portion 250, and a third pipe portion 254 that follows the second pipe portion 252 and communicates with the outlet pipes 242, 244. The second pipe portion 252 is illustratively positioned above shell 204 and above the water level of spa 100, more specifically above the top wall 102 of spa 100, to protect the air pump 232 by resisting the backflow of water from spa 100 to the air pump 232.

The control panel assembly 208 may be elevated relative to spa 100 to allow a user in spa 100 to more easily access buttons 210 on the control panel assembly 208. As shown in FIG. 15, the control panel assembly 208 may be mounted to the second pipe portion 252 at a location above the top wall 102 of spa 100. It is also within the scope of the present disclosure that the control panel assembly 208 may be telescopically coupled to shell 204 via a lifting rod, for example, for movement between a stored position below spa 100 and a use position above spa 100.

As discussed above, the air passageway 230 may extend above spa 100 to prevent the backflow of water from spa 100 to the air pump 232. To further prevent such backflow of water to the air pump 232, the illustrative air passageway 230 also includes a first check valve 260, a drain valve 280, and a second check valve 310. The first check valve 260 and the second check valve 310 may function simultaneously to provide dual-protection to the air pump 232, so that if one check valve is out of order, the other check valve can do the work. As shown in FIG. 16, the first check valve 260 is arranged between the discharge side 238 of air pump 232 and the first pipe portion 250. The second check valve 310 is arranged along the third pipe portion 254, more specifically below the first air outlet pipe 242 of the third pipe portion 254 and above the second air outlet pipe 244 of the third pipe portion 254.

Figure 17:
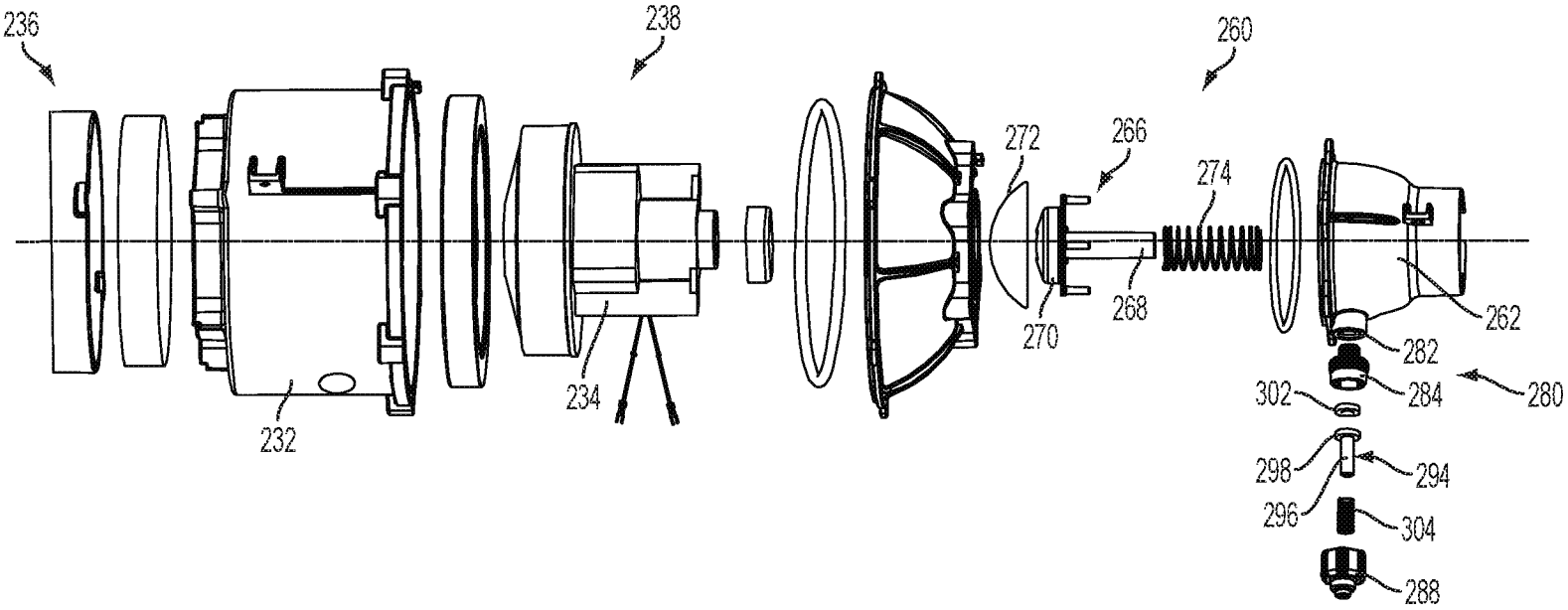
FIG. 17 is an exploded perspective view of the air pump, the first check valve, and the drain valve of FIG. 15.
Figure 18:
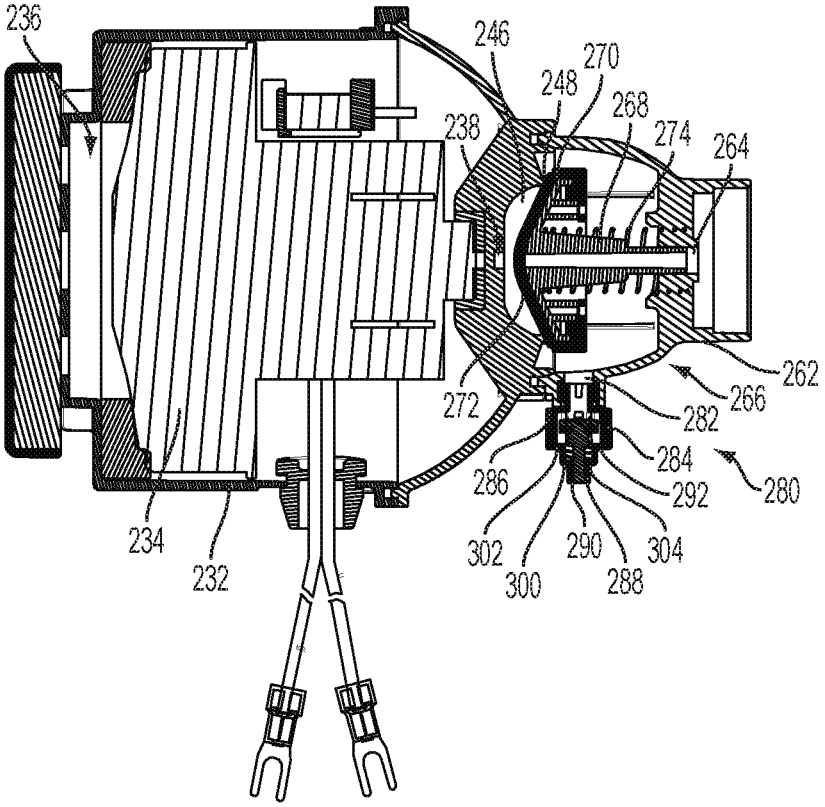
FIG. 18 is a cross-sectional view of the air pump, the first check valve, and the drain valve of FIG. 17.

The first check valve 260 is shown in FIGS. 17 and 18. The first check valve 260 includes a first housing 262 that is coupled to the air pump 232 and the first pipe portion 250 and defines an internal cavity 264. The first check valve 260 also includes a first valve core 266 having a stem 268, a head 270, and a hemispherical sealing piece 272 coupled to the head 270. The first check valve 260 further includes a first elastic spring 274 that interacts with the first valve core 266, the first elastic spring 274 being sleeved around the stem 268 of the first valve core 266 with one end positioned against head 270 and the other end positioned against the first housing 262.

In operation, the first valve core 266 moves longitudinally through the internal cavity 264 of the first housing 262 between a sealed or closed position and an open position. In the sealed position, the sealing piece 272 of the first valve core 266 extends into the delivery cavity 246 and seals against the valve seat surface 248, as shown in FIG. 18. In the open position, the sealing piece 272 of the first valve core 266 moves out of the delivery cavity 246 and separates from the valve seat surface 248.

The first housing 262 may also include a drain valve 280 coupled to a drain hole 282 from the first housing 262, as shown in FIGS. 17 and 18. The drain valve 280 includes an upper housing 284 having an uneven or wavy upper valve seat surface 286 and a lower housing 288 having a lower valve seat surface 290. The upper housing 284 and the lower housing 288 cooperate to define an internal drain cavity 292 in fluid communication with the drain hole 282. In certain embodiments, the drain hole 282 from the first housing 262 may be internally threaded and the upper housing 284 may be externally threaded to screw into to the first housing 262. The drain valve 280 also includes a drain valve core 294 having a stem 296, a flat head 298 having a clamping slot 300, and a circular sealing piece 302 positioned in the clamping slot 300. The drain valve 280 also includes an elastic spring 304 that interacts with the drain valve core 294, the elastic spring 304 being sleeved around the stem 296 of the drain valve core 294 with one end positioned against head 298 and the other end positioned against the lower housing 288.

In operation, the drain valve core 294 moves longitudinally through the internal drain cavity 292 between a sealed or closed position and an open position. In the sealed position, the sealing piece 302 of the drain valve core 294 is hermetically sealed against the lower valve seat surface 290. In the open position, the sealing piece 302 of the drain valve core 294 moves away from the lower valve seat surface 290 and the flat head 298 of the drain valve core 294 moves toward the uneven upper valve seat surface 286.

When the air pump 232 is on, the air generating assembly 234 operates and directs pressurized air from the suction side 236 of the air pump 232 to the delivery cavity 246. Upon reaching the first check valve 260, the air drives the first valve core 266 through the internal cavity 264 to the open position, in which the sealing piece 272 is separated from the valve seat surface 248 and the first elastic spring 274 is compressed. With the first check valve 260 in the open position, air from the delivery cavity 246 enters the first housing 262 and flows out of the internal cavity 264. At the same time, the drain valve core 294 of the drain valve 280 moves downward under the action of air pressure to the sealed position, in which the sealing piece 302 is sealed against the lower valve seat surface 290 and the elastic spring 304 is compressed. When the drain valve 280 is in the sealed position, the air pump 232 is able to operate normally.

When the air pump 232 is stopped, air pressure in the first check valve 260 disappears, and the first elastic spring 274 returns and drives the first valve core 266 to the sealed position, in which the sealing piece 272 is sealed against the valve seat surface 248. With the first check valve 260 in the sealed position, water from spa 100 is prevented from reaching the air pump 232. At the same time, air pressure disappears in the drain valve 280, and the elastic spring 304 returns and drives the drain valve core 294 upward to the open position, in which the sealing piece 302 of the drain valve core 294 moves away from the lower valve seat surface 290 and the flat head 298 of the drain valve core 294 moves toward the uneven upper valve seat surface 286. When the drain valve 280 is in the open position, any fluid that may be present in the first housing 262 is able to drain from the drain hole 282, through the internal drain cavity 292, and to the outside environment.

Figure 19:
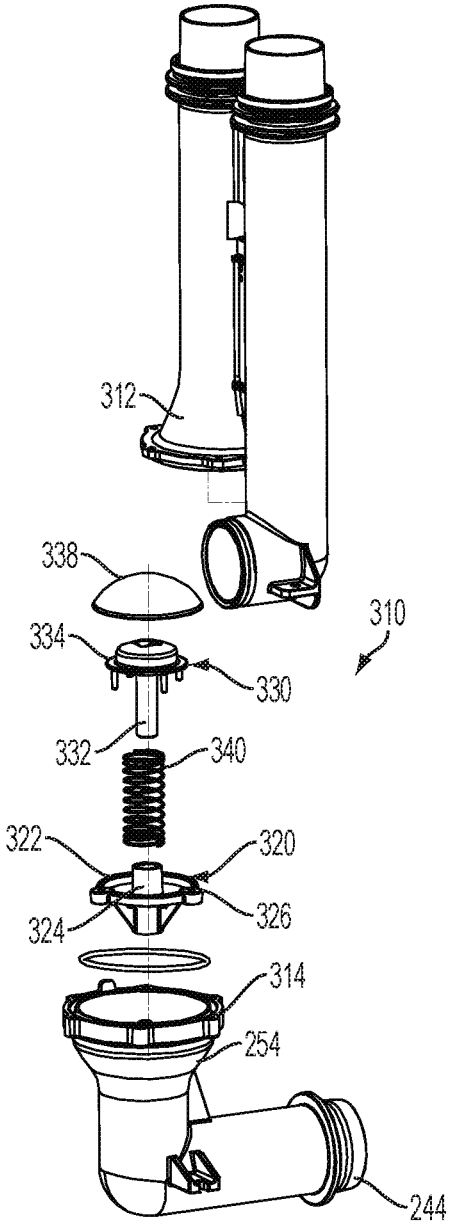
FIG. 19 is an exploded perspective view of the second check valve of FIG. 15.
Figure 20:
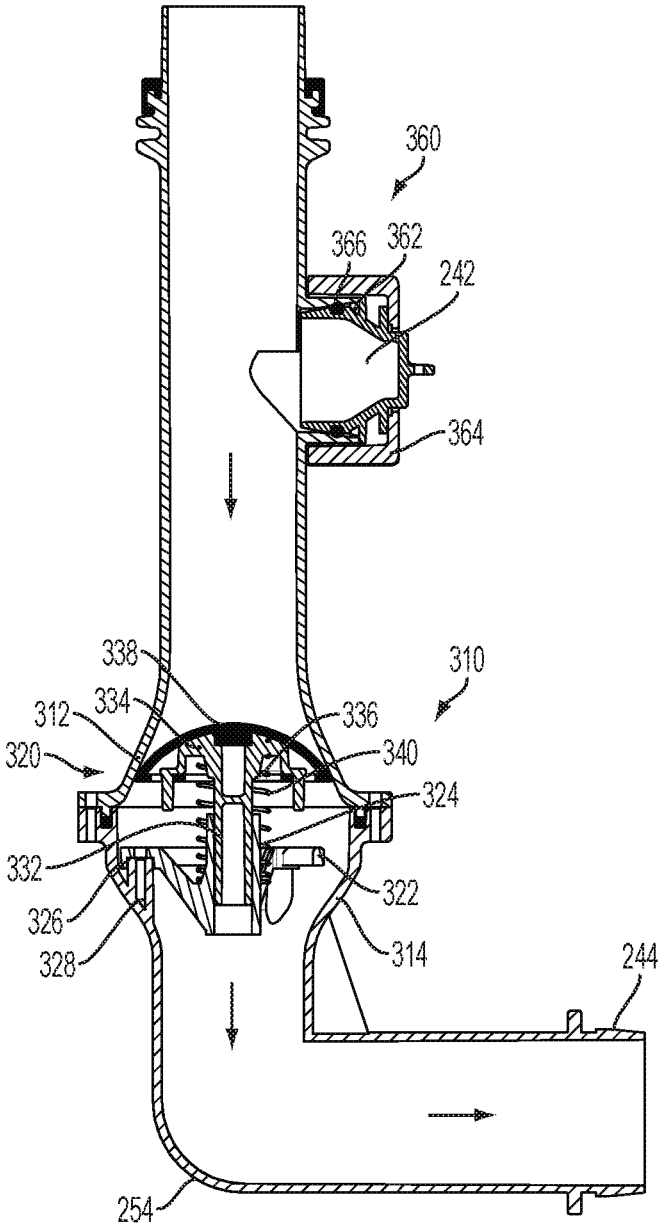
FIG. 20 is a cross-sectional view of the second check valve of FIG. 19.

The second check valve 310 is shown in FIGS. 19 and 20. As discussed above, the second check valve 310 is arranged along the third pipe portion 254. More specifically, the second check valve 310 is arranged between an upper section 312 and a lower section 314 of the third pipe portion 254, where the upper section 312 increases in diameter in a downward direction and the lower section 314 increases in diameter in the downward direction.

The second check valve 310 includes a second valve mount 320 having a circular locating ring 322 a hollow locating stem 324 located in the locating ring 322, and one or more apertures 326 corresponding to apertures 328 in the lower section 314 for fastening the second valve mount 320 to the lower section 314 of the third pipe portion 254, such as with screws (not shown). The second check valve 310 also includes a second valve core 330 having a stem 332, a head 334 with a lower stop platform or surface 336, and a hemispherical sealing piece 338 coupled to head 334. The second check valve 310 further includes a second elastic spring 340 that interacts with the second valve core 330, the second elastic spring 340 being sleeved around stem 332 of the second valve core 330 with one end positioned against head 333 and the other end positioned against the second valve mount 320.

In operation, the second valve core 330 moves longitudinally through the locating stem 324 of the second valve mount 320 between a sealed or closed position and an open position. In the sealed position, the sealing piece 338 of the second valve core 330 is hermetically sealed against the upper section 312 of the third pipe portion 254, as shown in FIG. 20. The sealing piece 338 may produce line contact with the upper section 312 of the third pipe portion 254 in the sealed position. In the open position, the sealing piece 338 of the second valve core 330 moves away from the upper section 312 of the third pipe portion 254 until the lower stop surface 336 of head 334 abuts the locating stem 324 of the second valve mount 320. Because of the line contact produced between the sealing piece 338 and the upper section 312 of the third pipe portion 254 in the sealed position, the sealing piece 338 may separate freely from the upper section 312 of the third pipe portion 254 without an adhesion phenomenon, even if the second check valve 310 has not out of use for some time, thereby increasing the service life of the second check valve 310.

When there is no air or water present in the third pipe portion 254, the second check valve 310 moves to the sealed position, in which the sealing piece 338 of the second valve core 330 is hermetically sealed against the upper section 312 of the third pipe portion 254 under the action of the second elastic spring 340. Because the upper section 312 of the third pipe portion 254 narrows in an upward direction, the sealing between the sealing piece 338 of the second valve core 330 and the upper section 312 of the third pipe portion 254 becomes progressively tighter as the water pressure from spa 100 increases.

When the air pump 232 is on, the air reaches the second check valve 310 and drives the second valve core 330 downward through the locating stem 324 of the second valve mount 320 to the open position, in which the sealing piece 338 is separated from the upper section 312 of the third pipe portion 254 and the second elastic spring 340 is compressed. With the second check valve 310 in the open position, air flows through the locating stem 324 of the second valve mount 320 and to spa 100.

Control system 200 may have at least three modes of operation, including: (1) an inflation mode, (2) a deflation mode, and (3) an aeration or bubble mode. Rather than having to buy multiple pieces of equipment to perform these individual functions, the user may rely on control system 200 to perform these functions, which may save space and costs. The user may select the desired mode using the control panel assembly 208. These modes of operation are described further below.

In the inflation mode, control system 200 may direct air from the discharge side 238 of the air pump 232, to the inflation pipe 242, and to the air chamber 110 of spa 100 to inflate spa 100. The inflation mode may be achieved by removing a detachable sealing cover assembly 360 from the inflation pipe 242 to open the inflation pipe 242. The sealing cover assembly 360 illustratively includes a sealing plug 362, a cap or cover body 364 that covers the sealing plug 362 and threadably couples to the inflation pipe 242, and a sealing ring 366 positioned between the sealing plug 362 and the inflation pipe 242. The inflation mode may also involve coupling an extension tube 368 to the inflation pipe 242 to increase the length of the inflation pipe 242 for coupling to the air chamber 110 of spa 100, as shown in FIG. 10. The inflation mode may also involve covering or closing the aeration pipe 244.

Figure 21:
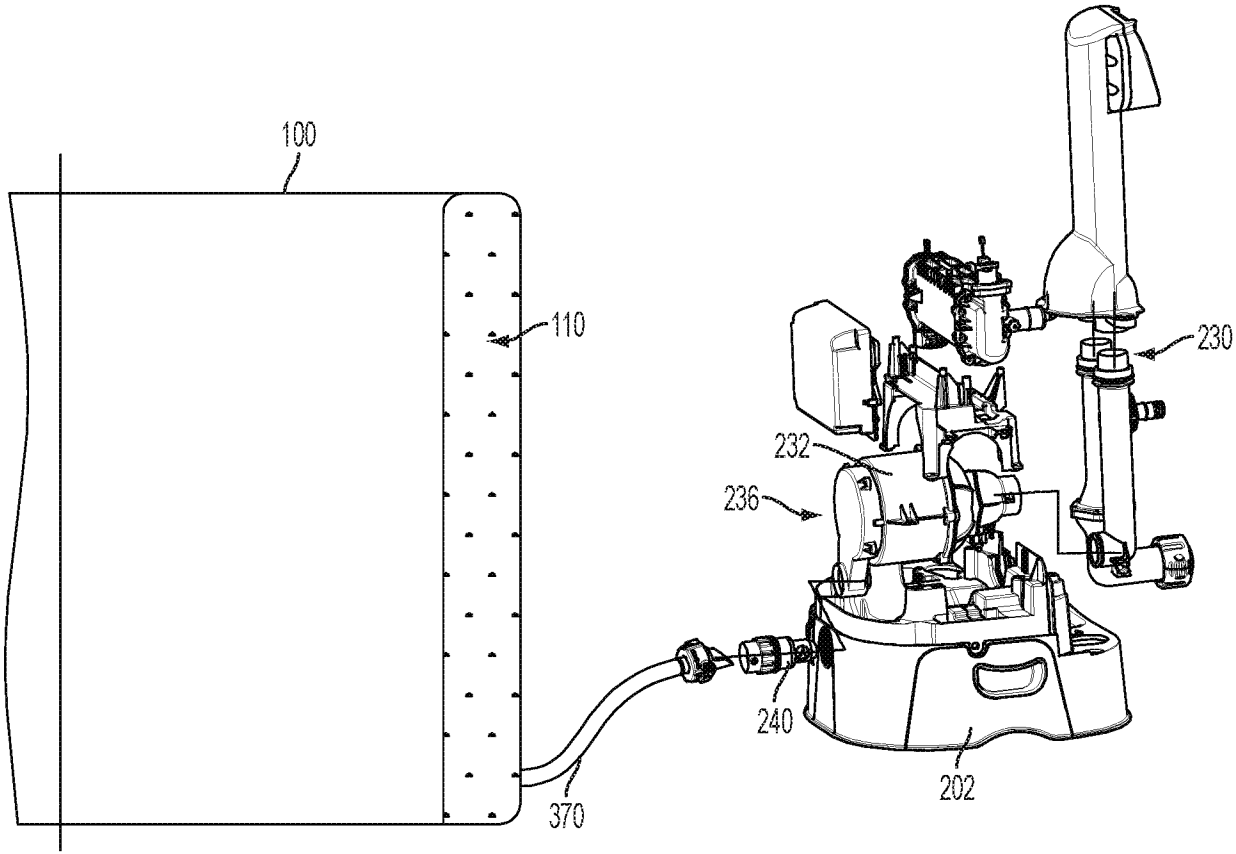
FIG. 21 is an exploded perspective view of the control system of FIG. 9 shown in a deflation mode.
Figure 22:
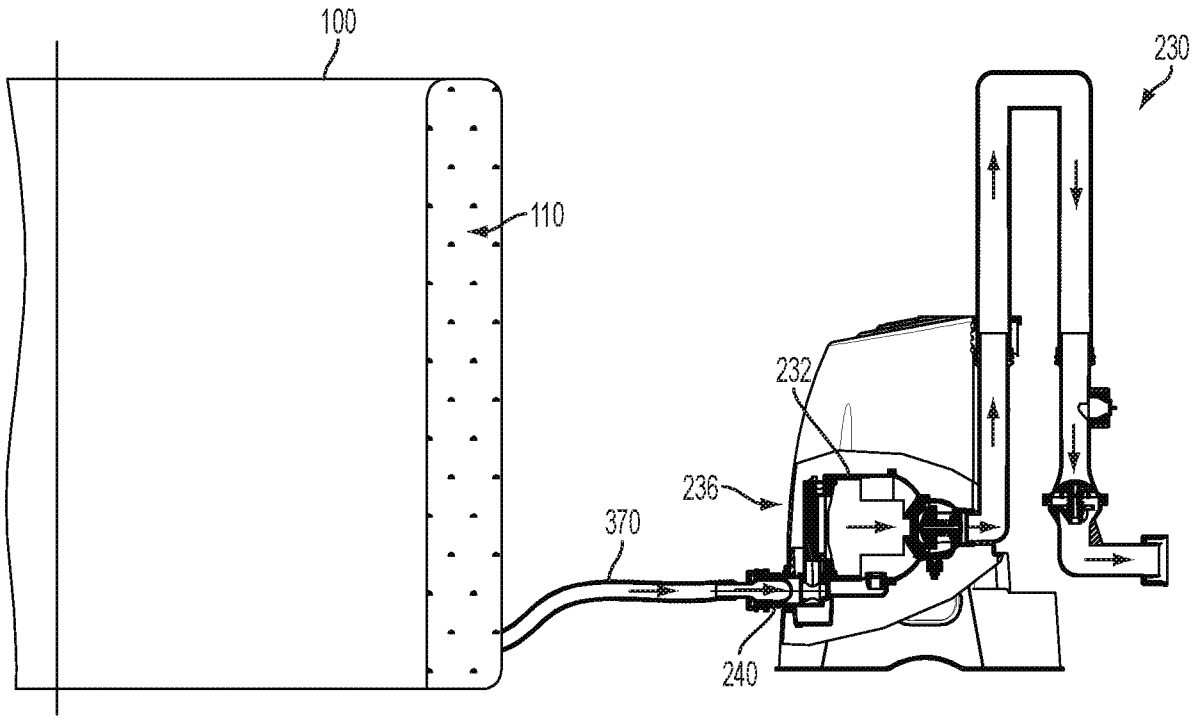
FIG. 22 is a cross-sectional view of the control system of FIG. 21.

In the deflation mode, control system 200 may pull air from the air chamber 110 of spa 100, through the deflation pipe 240, and into the suction side 236 of the air pump 232 to deflate spa 100, as shown in FIGS. 21 and 22. The deflation mode may involve coupling an extension tube 370 to the deflation pipe 240 to increase the length of the deflation pipe 240 for coupling to the air chamber 110 of spa 100. In other modes of operation, the suction side 236 of the air pump 232 may pull air from the surrounding atmosphere.

Figure 23:
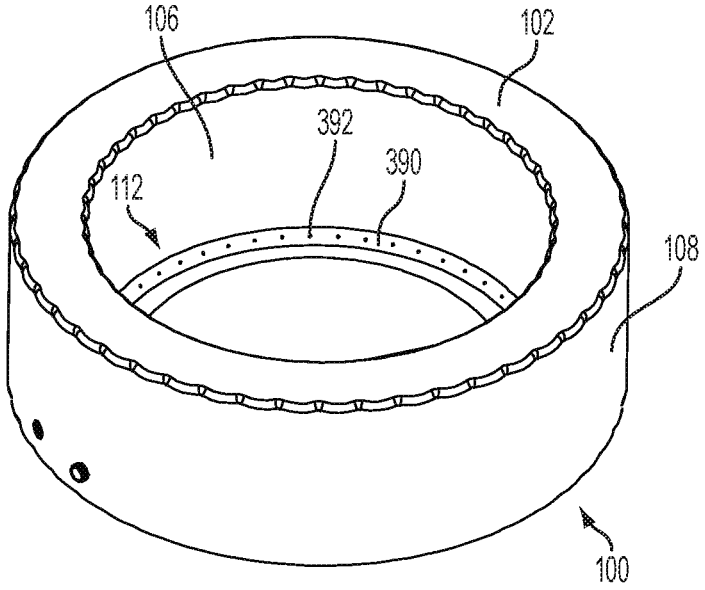
FIG. 23 is a perspective view of the inflatable spa of FIG. 9.
Figure 24:
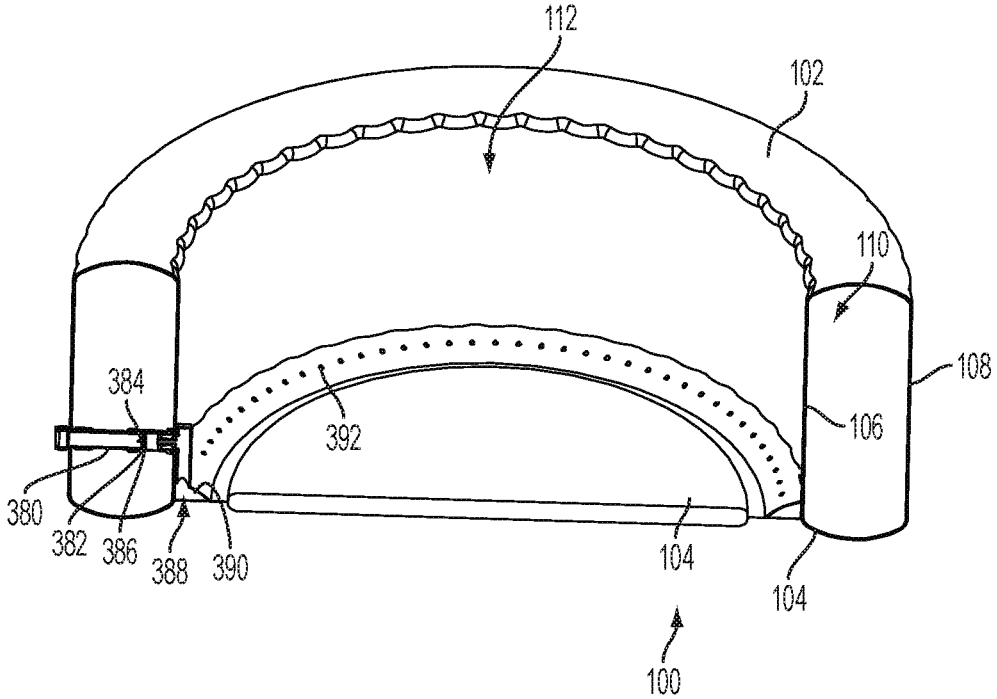
FIG. 24 is a perspective cross-sectional view of the inflatable spa of FIG. 23.

In the aeration or bubble mode, control system 200 may direct air from the discharge side 238 of the air pump 232, to the aeration pipe 244, and to the water cavity 112 of spa 100 to create massaging air bubbles in spa 100. The aeration mode may be achieved by covering the inflation pipe 242 with the sealing cover assembly 360 to close the inflation pipe 242 and opening the aeration pipe 244. As shown in FIGS. 23 and 24, spa 100 may include an air transport pipe 380 that communicates with the aeration pipe 244 and extends through the external wall 108, through the air chamber 110, and through the internal wall 106 toward the water cavity 112. The air transport pipe 380 may include a clapboard 382 having a mounting hole 384 and a third check valve 386 mounted in the mounting hole 384 to prevent the backflow of water from the water cavity 112 of spa 100. Spa 100 may also include an air delivery chamber 388 in communication with the air transport pipe 380. The air delivery chamber 388 is illustratively formed by an annular wall 390 that is hermetically coupled to the bottom wall 104 of spa 100 and includes a plurality of air delivery holes 392 to deliver massaging air bubbles from the air delivery chamber 388 into the water cavity 112 of spa 100. Although the illustrative air delivery chamber 388 has an annular configuration, the air delivery chamber 388 may also have a multi-line configuration, for example.

Figure 25:
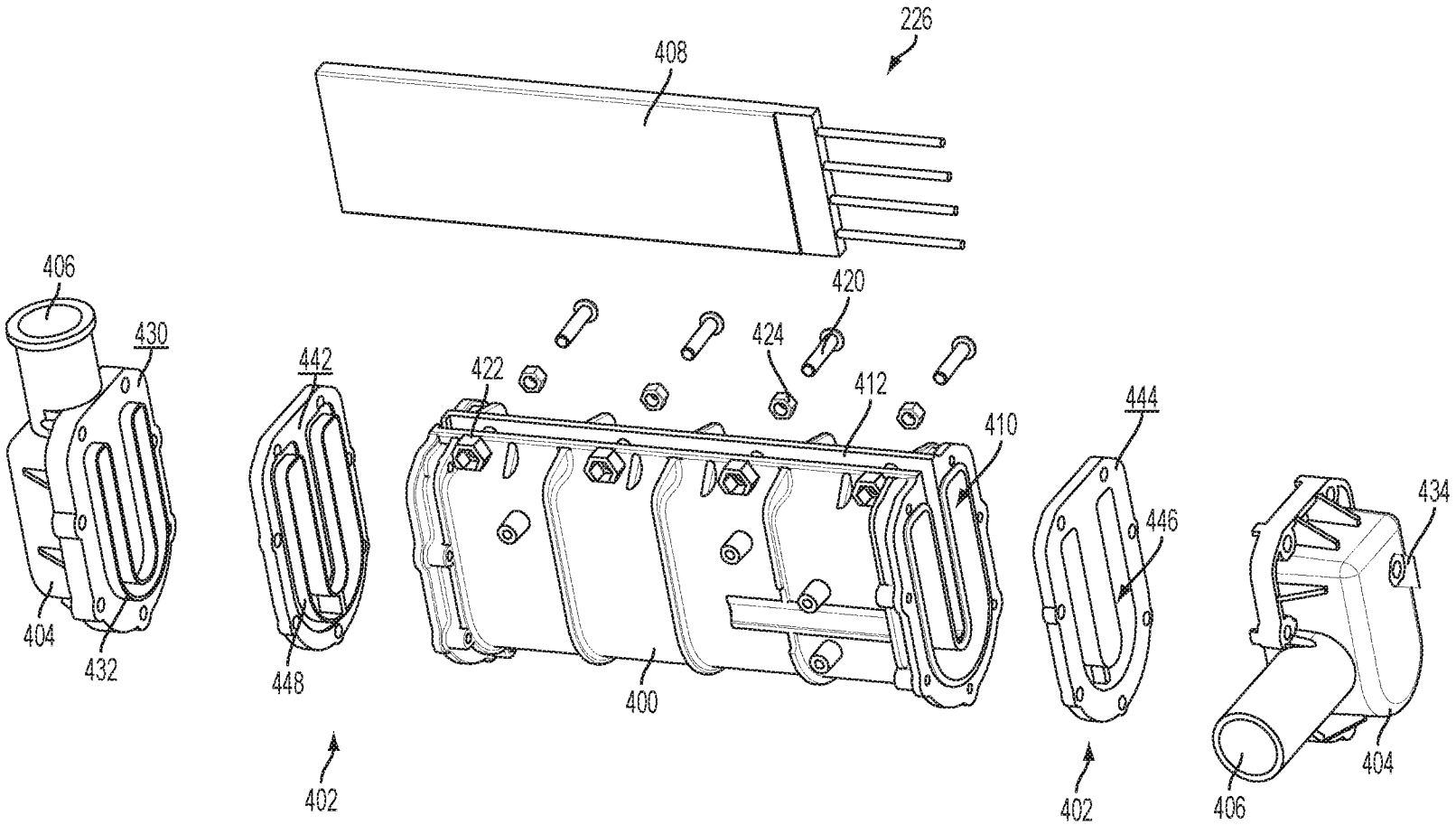
FIG. 25 is an exploded perspective view of an exemplary heating unit of the present disclosure.
Figure 26:
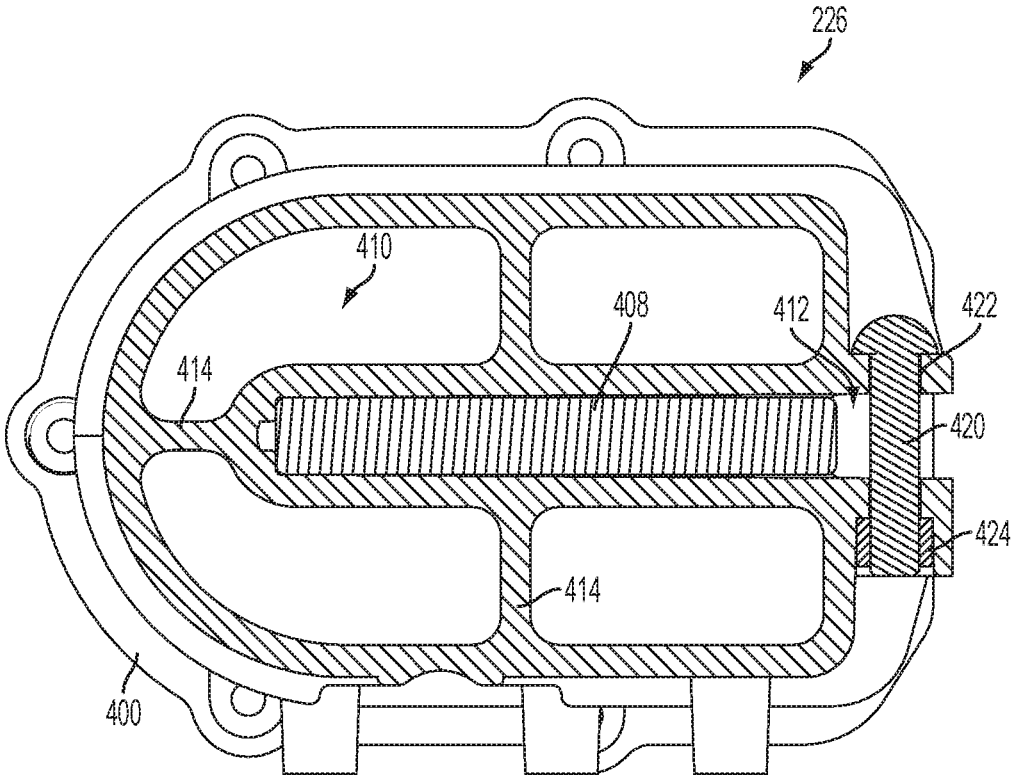
FIG. 26 is a cross-sectional view of the heating unit of FIG. 25.

An exemplary heating unit 226 for use in control system 200 is shown in FIGS. 25 and 26. The heating unit 226 includes a U-shaped housing 400, two sealing elements 402, two end joints 404, each having a water cavity 406, and a heating element 408.

The U-shaped housing 400 includes a U-shaped cavity 410 that runs longitudinally from end-to-end and an assembly groove 412 at the center of the U-shaped cavity 410 that also runs longitudinally from end-to-end. The U-shaped cavity 410 and the assembly groove 412 may create a compact structure having good heating and water flow capacity. The U-shaped housing 400 may also include a plurality of internal reinforcing ribs 414, as shown in FIG. 26, that are spaced apart along the U-shaped cavity 410 to increase the strength of the U-shaped housing 400.

The heating element 408 may be a positive temperature coefficient (PTC) heating plate or another suitable heating element that safe, reliable, stable, and provides a high heating effect. The heating element 408 may be disposed in the assembly groove 412 of the U-shaped housing 400 to heat the water flowing through the adjacent U-shaped cavity 410, which illustratively surrounds the heating element 408 on three of its four edges for substantial heating. The heating element 408 may be held securely in place inside the assembly groove 412 by inserting a plurality of bolts 420 through receptacles 422 in the U-shaped housing 400 and across the assembly groove 412 and then securing bolts 420 with nuts 424.

The two end joints 404 are respectively disposed at both ends of the U-shaped housing 400. The water cavities 406 of the end joints 404 are arranged in fluid communication with the U-shaped cavity 410 of the U-shaped housing 400. On the mating surface 430 of each end joint 404 that faces inwardly toward with the U-shaped housing 400, the end joint 404 may include a first U-shaped wall 432 that projects from the mating surface 430 to couple the corresponding water cavity 406 to the U-shaped cavity 410 in the U-shaped housing 400 via the corresponding sealing element 402, as discussed further below. One or both of the end joints 404 may include a thermostat 434 to measure the temperature of the water in the heating unit 226 before and/or after being heated by the heating element 408.

The two sealing elements 402 are respectively disposed between the U-shaped housing 400 and the end joints 404. Each sealing element 402 may include an inward mating surface 442 that faces inwardly to mate with the U-shaped housing 400, an outward mating surface 444 that faces outwardly to mate with the mating surface 430 of the corresponding end joint 404, and a U-shaped slot 446 that extends between the inward mating surface 442 and the outward mating surface 444. On the inward mating surface 442, each sealing element 402 may include a second U-shaped wall 448 that projects from the inward mating surface 442 and into the U-shaped cavity 410 in the U-shaped housing 400 to couple the U-shaped slot 446 to the U-shaped cavity 410 in a sealed manner. On the outward mating surface 444, each U-shaped slot 446 may receive the first U-shaped wall 432 of the corresponding end joint 404 in a sealed manner.

Returning to FIGS. 10-14, controller 206 may ensure that the electric current of the control system 200 stays below a predetermined limit, such as a standard household limit of 13 A to 16 A. In one embodiment, controller 206 may limit the power supply to one or more other units of the control system 200 when the air pump 232 is activated in the aeration mode, and controller 206 may restore the power supply to the other units of the control system 200 when the air pump 232 is deactivated. For example, controller 206 may automatically limit the power supply to the heating unit 226 to about 50% or less when the air pump 232 is activated in the aeration mode, and controller 206 may automatically restore the power supply to the heating unit 226 to 100% when the air pump 232 is deactivated. When necessary, the user may also be advised to deactivate one or more other units of the control system 200, such as the salt water unit (not shown).

3. Jetted Water Embodiment

Figure 27:
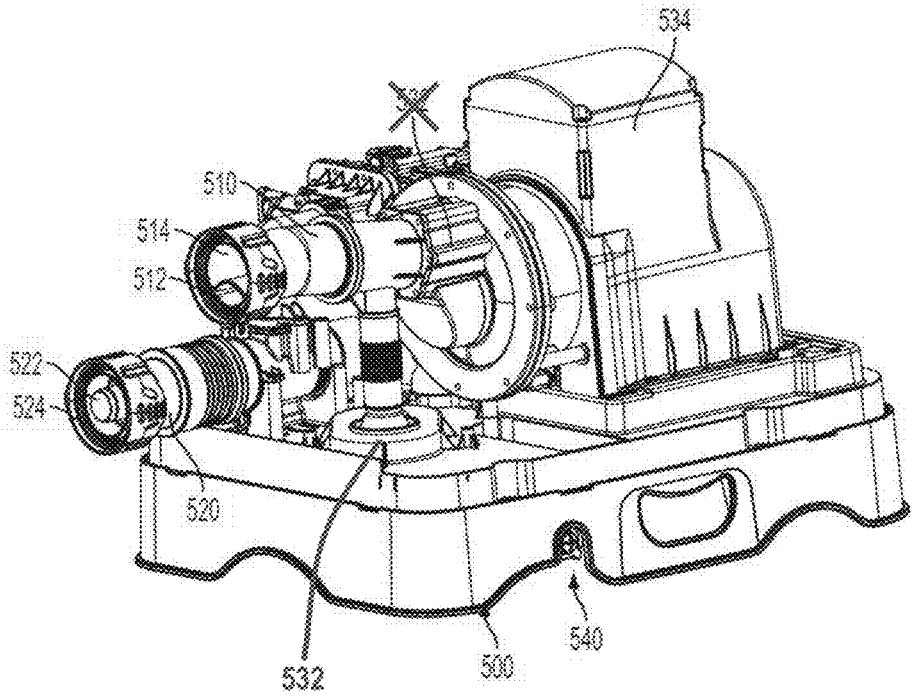
FIG. 27 is a perspective view an exemplary control system of the present disclosure for supplying jetted water to an inflatable spa.
Figure 28:
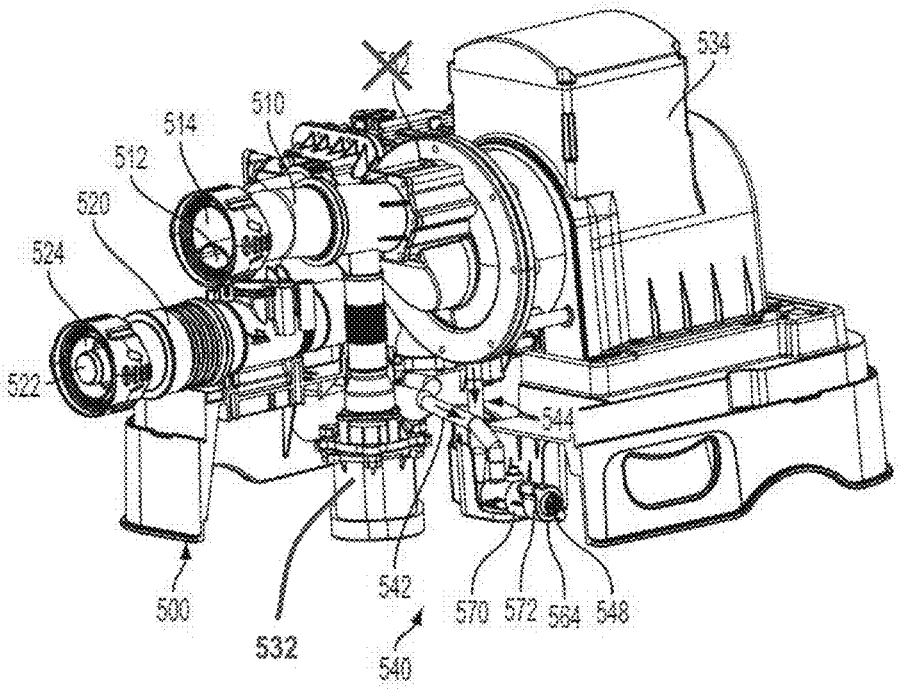
FIG. 28 is a perspective view of the control system of FIG. 27 with a base partially removed to show a drain assembly.

Referring next to FIG. 27, a second control system 500 is shown for use with spa 100. The second control system 500 may include various features in common with the first control system 200, except as described below. For example, the second control system 500 may include a controller similar to the above-described controller 206 of FIGS. 10-14 and a heating unit similar to the above-described heating unit 226 of FIGS. 25 and 26. The second control system 500 may also include a hard water treatment unit (not shown) and/or a salt water unit (not shown).

The illustrative control system 500 includes an inlet pipe 510 having a filtered water inlet portion 512 and a jetted water inlet portion 514. Although the filtered water inlet portion 512 and the jetted water inlet portion 514 are substantially parallel to one another and part of the same inlet pipe 510, the filtered water inlet portion 512 is independent of the jetted water inlet portion 514 in FIG. 27. Combining the filtered water inlet portion 512 and the jetted water inlet portion 514 in the same inlet pipe 510 may decrease the number of pipes and holes required in spa 100, decrease the size and cost of the control system 500, and simplify assembly of the control system 500.

The control system 500 further includes an outlet pipe 520 having a filtered water outlet portion 522 and a jetted water outlet portion 524. Although the filtered water outlet portion 522 and the jetted water outlet portion 524 are collinear with one another and part of the same outlet pipe 520, the filtered water outlet portion 522 is independent of the jetted water outlet portion 524 in FIG. 27. As discussed above with respect to the inlet pipe 510, combining the filtered water outlet portion 522 and the jetted water outlet portion 524 in the same outlet pipe 520 may decrease the number of pipes and holes required in spa 100, decrease the size and cost of the control system 500, and simplify assembly of the control system 500.

The control system 500 still further includes a filtered water pump 532 and a jetted water pump 534. In operation, the filtered water pump 532 directs water along a filtered water passageway from the filtered water inlet portion 512 to the filtered water outlet portion 522. The jetted water pump 534 directs water along a jetted water passageway from the jetted water inlet portion 514 to the jetted water outlet portion 524.

The control system 500 still further includes a drain assembly 540 including a filtered water drain passageway 542 from the filtered water passageway, a jetted water drain passageway 544 from the jetted water passageway, a drain valve body 546 located below the filtered water passageway and the jetted water passageway, and a drain valve plug 548 having a first sealing element 550 and a second sealing element 552.

The drain valve body 546 includes a first inlet 560 in fluid communication with the filtered water drain passageway 542, a second inlet 562 in fluid communication with the jetted water drain passageway 544, and a combined outlet 564 that discharges water from the filtered water drain passageway 542 and the jetted water drain passageway 544. The drain valve body 546 also includes a first portion 570 that defines the first and second inlets 560, 562 and a second portion or cover 572 that defines the outlet 564. In the illustrated embodiment of FIG. 29, the first portion 570 of the drain valve body 546 is internally threaded.

The drain valve plug 548 extends through the outlet 564 in the second portion 572 of the drain valve body 546 and into the first portion 570 of the drain valve body 546. The drain valve plug 548 is movably coupled to the drain valve body 546. In the illustrated embodiment of FIG. 29, the drain valve plug 548 is externally threaded for threaded, rotatable engagement with the first portion 570 of the drain valve body 546.

Figure 29:
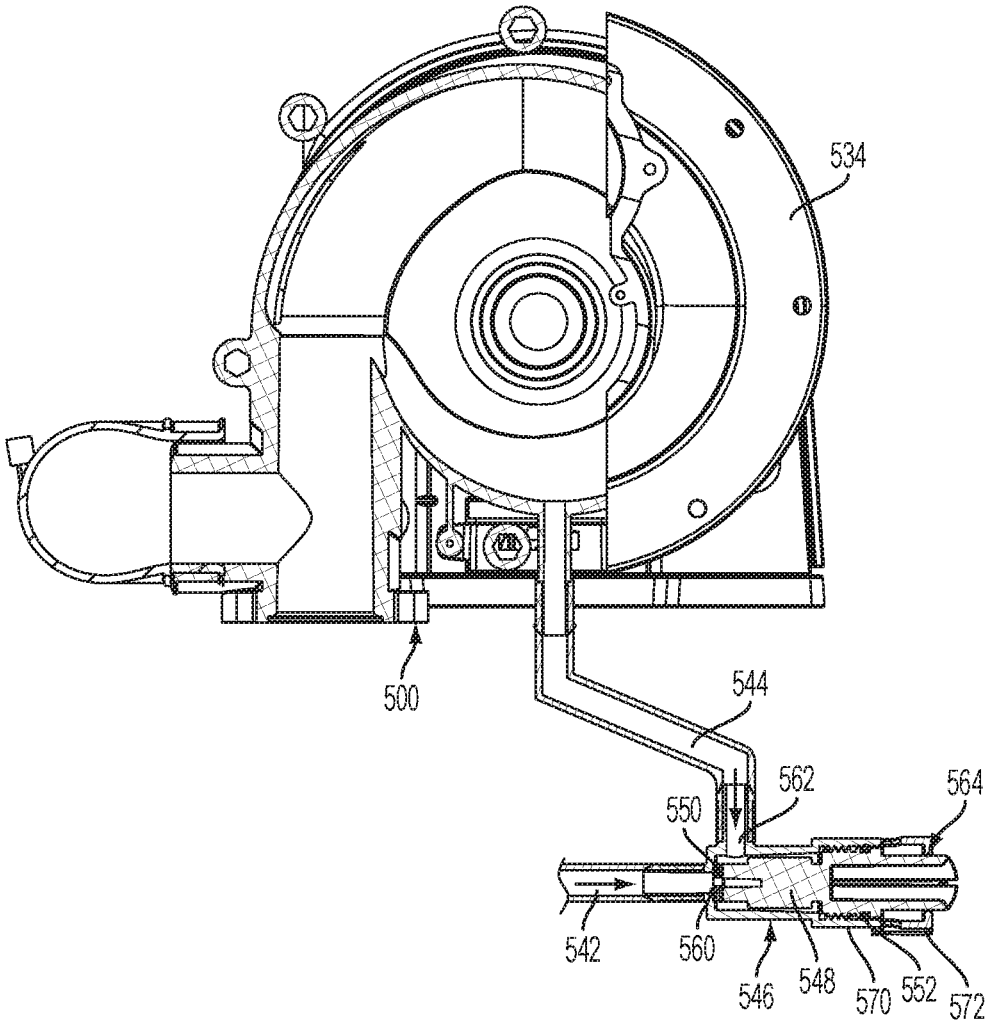
FIG. 29 is a side cross-sectional view of the control system and the drain assembly of FIG. 28.
Figure 30:
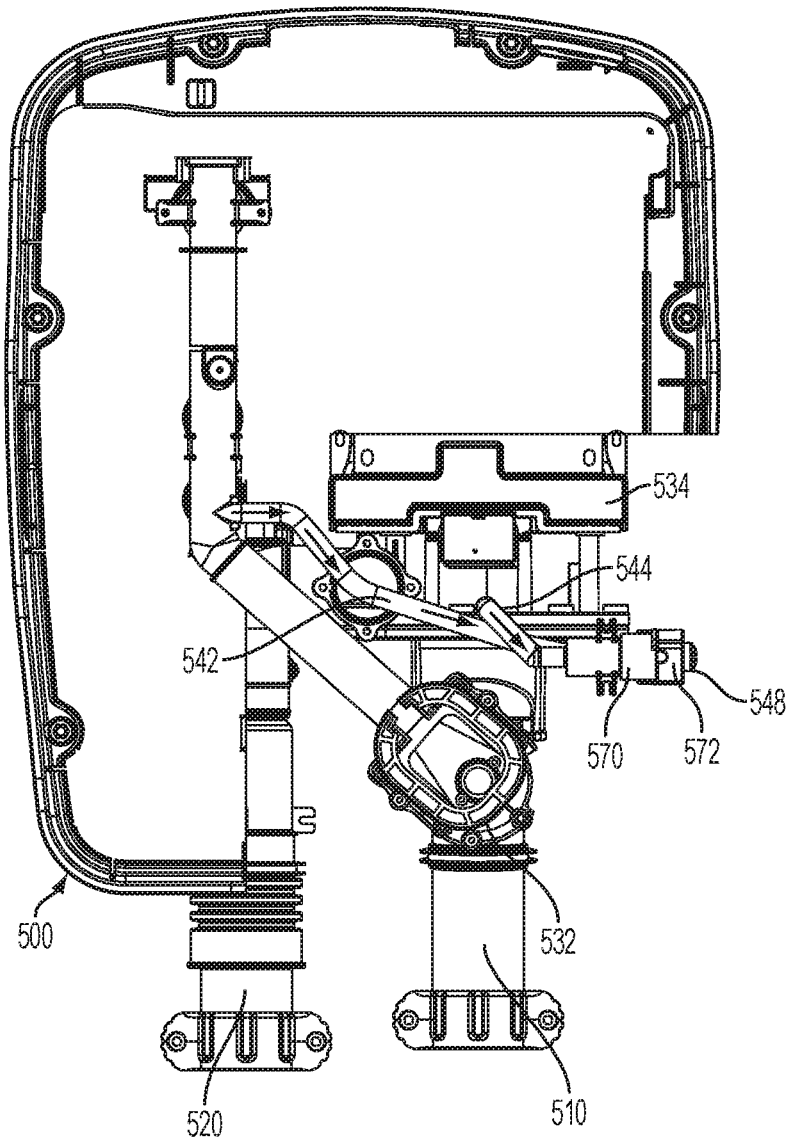
FIG. 30 is a bottom plan view of the control system and the drain assembly of FIG. 28.

The first sealing element 550 is coupled to the drain valve plug 548 and is configured to selectively open or close the first inlet 560 from the filtered water drain passageway 542. As shown in FIG. 29, the first sealing element 550 faces the first inlet 560 from the base of the drain valve plug 548.

The second sealing element 552 is coupled to the drain valve plug 548 and is configured to selectively open or close the second inlet 562 from the jetted water drain passageway 544. As shown in FIG. 29, the second sealing element 552 is positioned between the drain valve plug 548 and the drain valve body 546. The second sealing element 552 is tightly fit with the first portion 570 of the drain valve body 546 and is loosely fit with the second portion 572 of the drain valve body 546.

When the control system 500 operates normally, the drain valve plug 548 may be threaded into the drain valve body 546. The first sealing element 550 is pressed against the first inlet 560 to close the filtered water drain passageway 542. The second sealing element 552 is pressed against the first portion 570 of the drain valve body 546 to also close the jetted water drain passageway 544.

When the control system 500 does not operate, the drain valve plug 548 may be threaded away from the drain valve body 546. The first sealing element 550 is separated from the first inlet 560 to open the filtered water drain passageway 542 to the outlet 564 around the drain valve plug 548. The second sealing element 552 is separated from the first portion 570 of the drain valve body 546 and moved into the second portion 572 of the drain valve body 546 to open the jetted water drain passageway 544 to the outlet 564 around the loosened drain valve plug 548. The ability to drain the control system 500 by operating a single drain valve plug 548 provides convenience, increased life, and improved serviceability.

Figure 31:
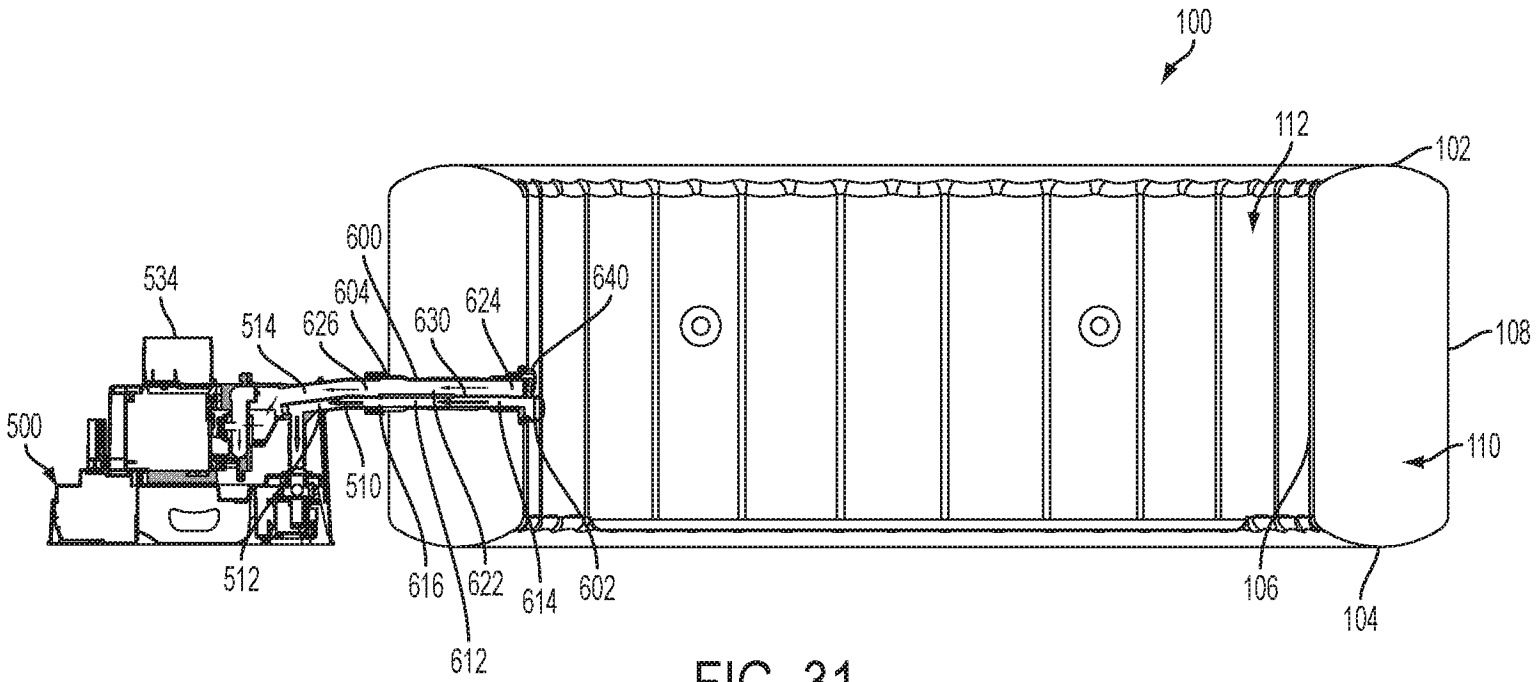
FIG. 31 is a schematic view of a water inlet system to the control system of FIG. 27 including a water inlet pipe with a filtering cover.
Figure 32:
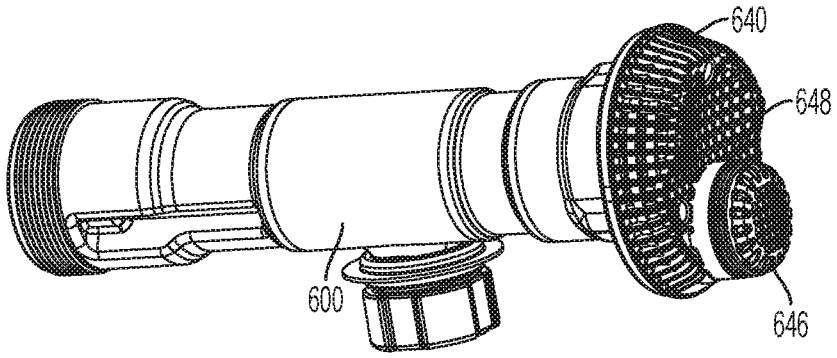
FIG. 32 is a perspective view of the water inlet pipe of FIG. 31.
Figure 33:
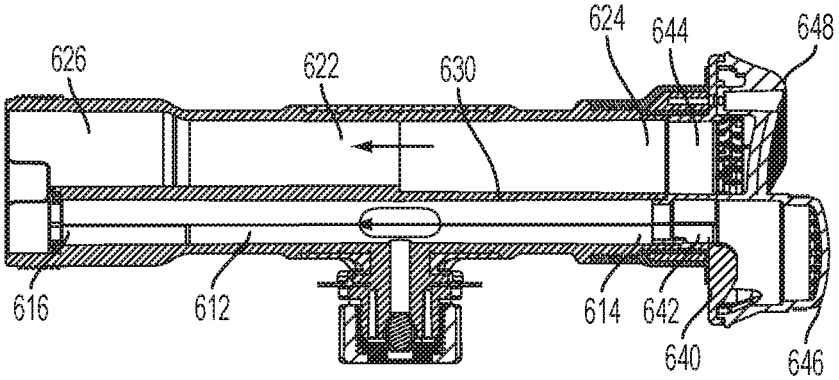
FIG. 33 is a cross-sectional view of the water inlet pipe of FIG. 32.

Referring next to FIGS. 31-33, spa 100 includes an inlet pipe 600 that extends from the water cavity 112, through a first opening 602 in the internal wall 106, through the air chamber 110, and through a first opening 604 in the external wall 108 to direct water from the water cavity 112 of spa 100 to the inlet pipe 510 of the control system 500. The illustrative inlet pipe 600 includes a filtered water inlet portion 612 having a first end 614 located at the internal wall 106 in fluid communication with the water cavity 112 and a second end 616 located at the external wall 108 in fluid communication with the filtered water inlet portion 512 of the control system 500. The illustrative inlet pipe 600 also includes a jetted water inlet portion 622 having a first end 624 located at the internal wall 106 in fluid communication with the water cavity 112 and a second end 626 located at the external wall 108 in fluid communication with the jetted water inlet portion 514 of the control system 500.

Like the filtered water inlet portion 512 and the jetted water inlet portion 514 of the inlet pipe 510 associated with the control system 500, the filtered water inlet portion 612 and the jetted water inlet portion 622 of the inlet pipe 600 associated with spa 100 may be independent and parallel to one another, with a separating wall 630 disposed therebetween. In cross-section, the separating wall 630 may be circular in shape, arcuate in shape, rectangular in shape, or wavy in shape, for example. According to an exemplary embodiment of the present disclosure, the filtered water inlet portion 612 is smaller in diameter than the jetted water inlet portion 622 to ensure that the water pressure of the jetted water passageway is higher than that of the filtered water passageway.

The inlet pipe 600 further includes a filtering cover 640. The cover 640 includes a first portion 642 in fluid communication with the first end 614 of the filtered water inlet portion 612 of the inlet pipe 600, and a second portion 644 in fluid communication with the first end 624 of the jetted water inlet portion 622 of the inlet pipe 600, as shown in FIG. 33. Like the filtered water inlet portion 612 and the jetted water inlet portion 622 of the inlet pipe 600, the corresponding first portion 642 and second portion 644 of the cover 640 may be independent and parallel to one another, and the first portion 642 may be smaller than the second portion 644. Cover 640 may be positioned at the first opening 602 in the internal wall 106 to interface with the water cavity 112 of spa 100, as shown in FIG. 31.

Figure 34:
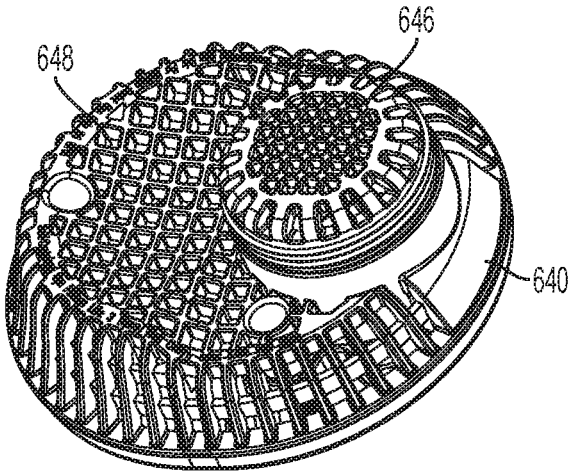
FIG. 34 is a perspective view of the filtering cover of FIG. 31.
Figure 35:
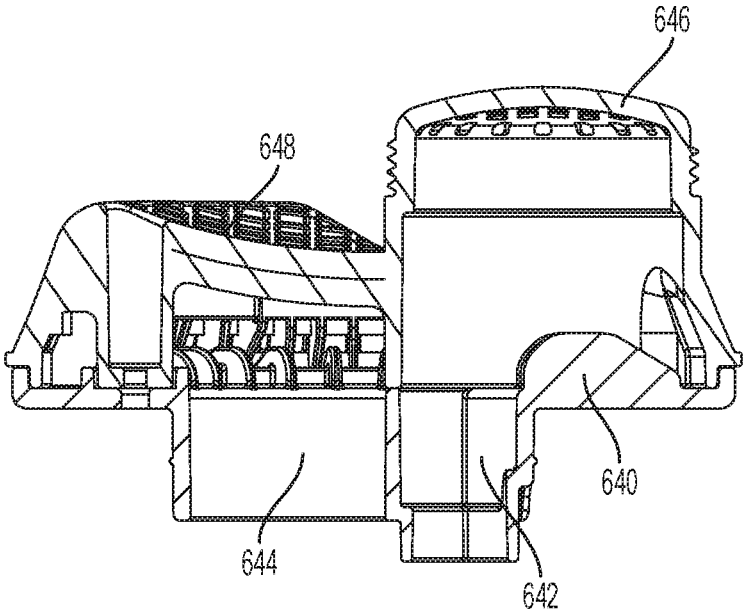
FIG. 35 is a cross-sectional view of the filtering cover of FIG. 34.

Cover 640 is shown in more detail in FIGS. 34 and 35. A first filter screen 646 is shown covering the first portion 642 and a second filter screen 648 is shown covering the second portion 644. The first filter screen 646 and the second filter screen 648 may be a unitary piece formed during a single forming step, which may decrease the size and cost of cover 640 and simplify assembly of cover 640. The first filter screen 646 may be externally threaded for convenient coupling to other pipes, if applicable.

Figure 36:
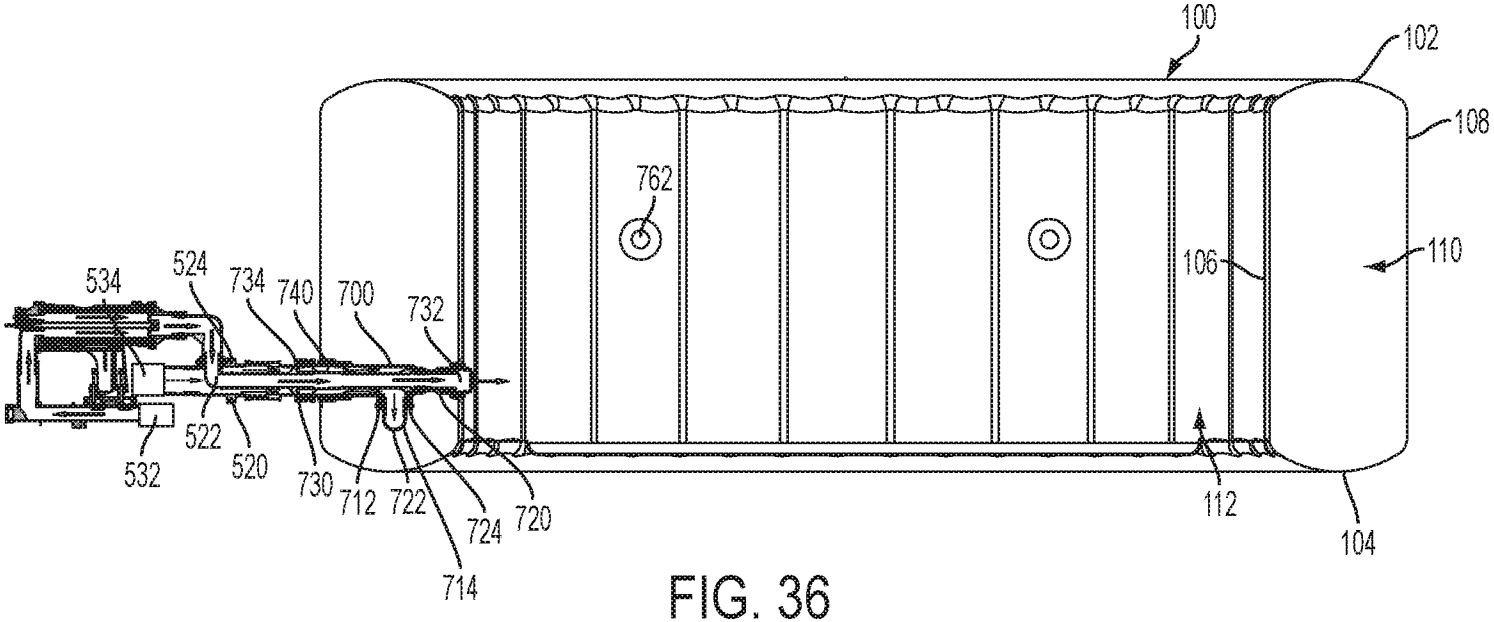
FIG. 36 is a schematic view of a water outlet system from the control system of FIG. 27 including a water outlet pipe.
Figure 37:
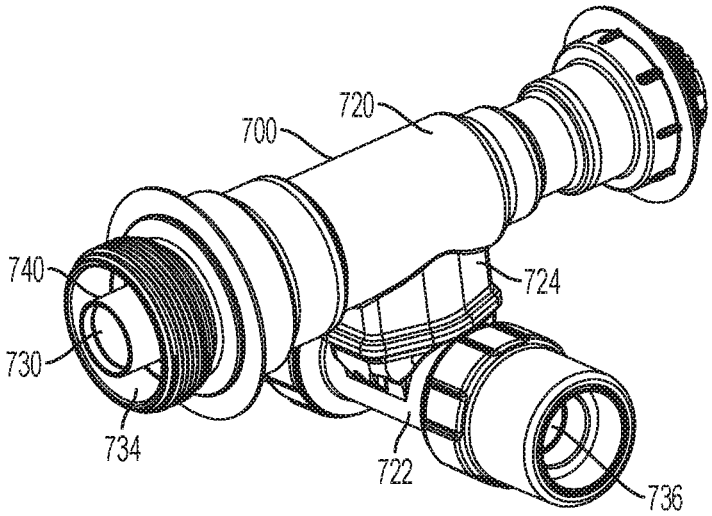
FIG. 37 is a perspective view of the water outlet pipe of FIG. 36.
Figure 38:
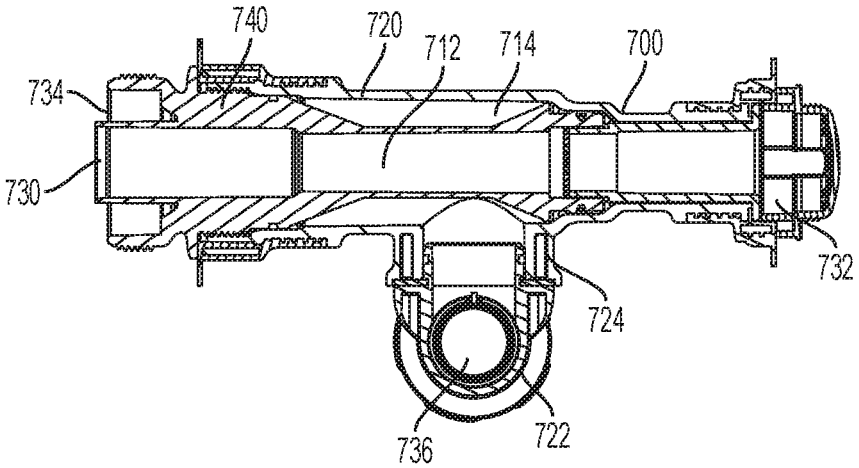
FIG. 38 is a cross-sectional view of the water outlet pipe of FIG. 37.

Referring next to FIGS. 36-38, spa 100 includes an outlet pipe 700 that extends from the outlet pipe 520 of the control system 500 to the water cavity 112 of spa 100 to return water to spa 100. The illustrative outlet pipe 700 includes a filtered water outlet portion 712 in fluid communication with the filtered water outlet portion 522 of the control system 500 and a jetted water outlet portion 714 in fluid communication with the jetted water outlet portion 524 of the control system 500.

The outlet pipe 700 includes a main body 720 and a diversion body 722 connected together via an intermediate connection body 724. The diversion body 722 is illustratively perpendicular to the main body 720. The filtered water outlet portion 712 extends through the main body 720. As shown in FIG. 36, the filtered water outlet portion 712 extends from a first end 730 of the main body 720 located at the external wall 108 of spa 100 to a second end 732 of the main body 720 located at the internal wall 106 of spa 100 and above the diversion body 722. The jetted water outlet portion 714 extends initially through the main body 720, then through the connection body 724, and then through the diversion body 722 for distribution around spa 100. As shown in FIG. 36, jetted water outlet portion 714 extends from a first end 734 of the main body 720 located at the external wall 108 of spa 100 to two second ends or outlets 736 located on either side of the main body 720.

Like the filtered water outlet portion 522 and the jetted water outlet portion 524 of the outlet pipe 520 associated with the control system 500, the filtered water outlet portion 712 and the jetted water outlet portion 714 of the outlet pipe 700 associated with spa 100 may be independent and collinear with one another, at least initially, with a separating wall 740 disposed therebetween. As shown in FIG. 38, the separating wall 740 extends through the main body 720 to separate the filtered water outlet portion 712 from the jetted water outlet portion 714 in the main body 720. In cross-section, the separating wall 740 may be circular in shape, arcuate in shape, rectangular in shape, or wavy in shape, for example. According to an exemplary embodiment of the present disclosure, the filtered water outlet portion 712 is smaller in diameter than the jetted water outlet portion 714 to ensure that the water pressure of the jetted water passageway is higher than that of the filtered water passageway.

Figure 39:
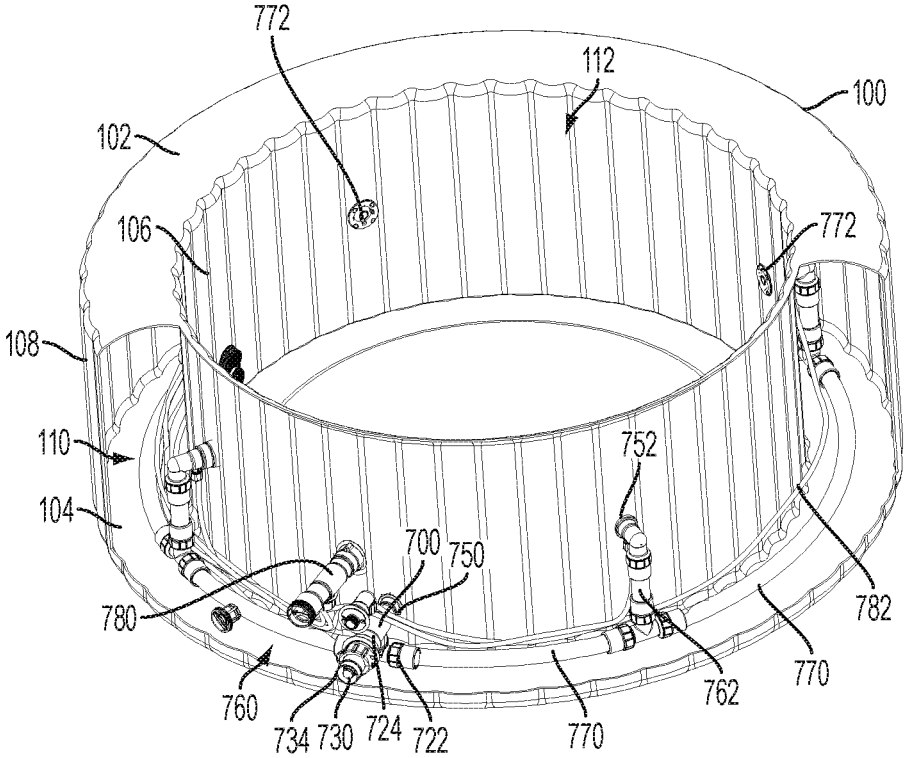
FIG. 39 is a perspective view of a spa with an external wall partially removed to show a jetted water pipe network including a plurality of spray nozzles.

The internal wall 106 of spa 100 may define one or more filtered water openings 750 for delivering filtered water to the water cavity 112 and one or more jetted water openings 752 for delivering jetted water to the water cavity 112. In the illustrated embodiment of FIG. 39, the internal wall 106 of spa 100 includes one filtered water opening 750 and several jetted water openings 752 spaced annularly about spa 100.

Referring next to FIGS. 39-42, spa 100 may include a jetted water pipe network 760 in fluid communication with the outlet pipe 700 to deliver jetted water to the water cavity 112 of spa 100. The outlet pipe 700 and the jetted water pipe network 760 may be substantially contained or concealed within the air chamber 110 of spa 100 to enhance the appearance of spa 100, to protect the outlet pipe 700 and the jetted water pipe network 760 from the surrounding environment, to simplify assembly, disassembly, storage, and transport of spa 100, and to reduce leakage from spa 100.

Figure 42:
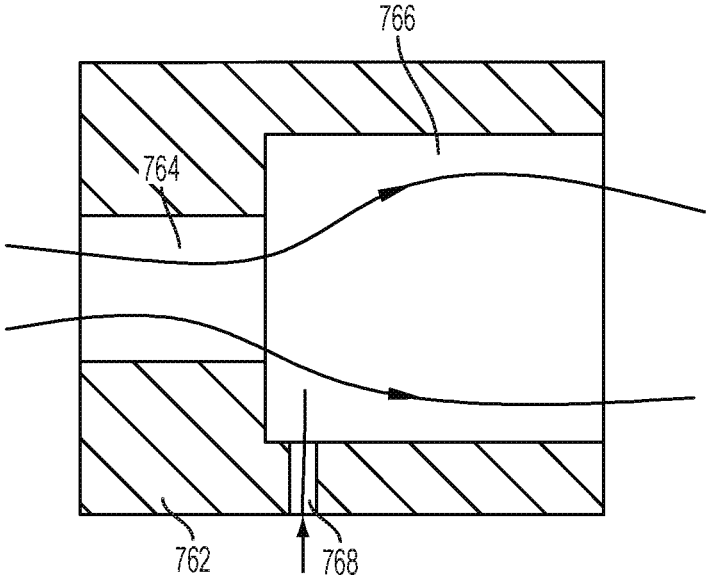
FIG. 42 is a cross-sectional view of the spray nozzle of FIG. 39.

The jetted water pipe network 760 includes a plurality of spray nozzles 762 that extend through the jetted water openings 752 in the internal wall 106 of spa 100. As shown in FIG. 42, each spray nozzle 762 may include a first segment 764 having a small internal diameter and a second segment 766 having a large internal diameter in fluid communication with the first segment 764. Each spray nozzle 762 may also include an air hole 768 into the second segment 766 at a location near the first segment 764. The diameter of the air hole 768 may be less than or equal to 0.8 mm, for example, to prevent water from leaking through the air hole 768.

Figure 40:
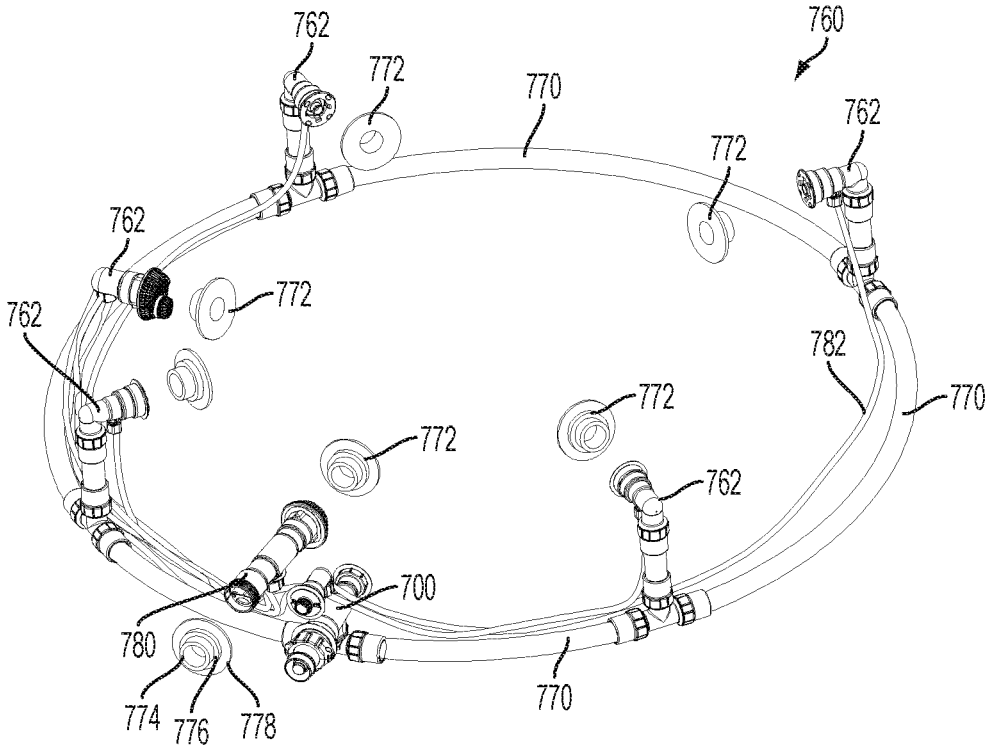
FIG. 40 is a perspective view of the jetted water pipe network of FIG. 39.

The jetted water pipe network 760 also includes a flexible connecting pipe 770 (e.g., a hose) between adjacent spray nozzles 762. The flexible nature of the connecting pipe 770 may allow the deflated spa 100 to be folded for storage and/or transport. As shown in FIG. 40, the flexible connecting pipe 770 of the jetted water pipe network 760 extends annularly around spa 100 from both outlets 736 of the outlet pipe 700.

Figure 41:
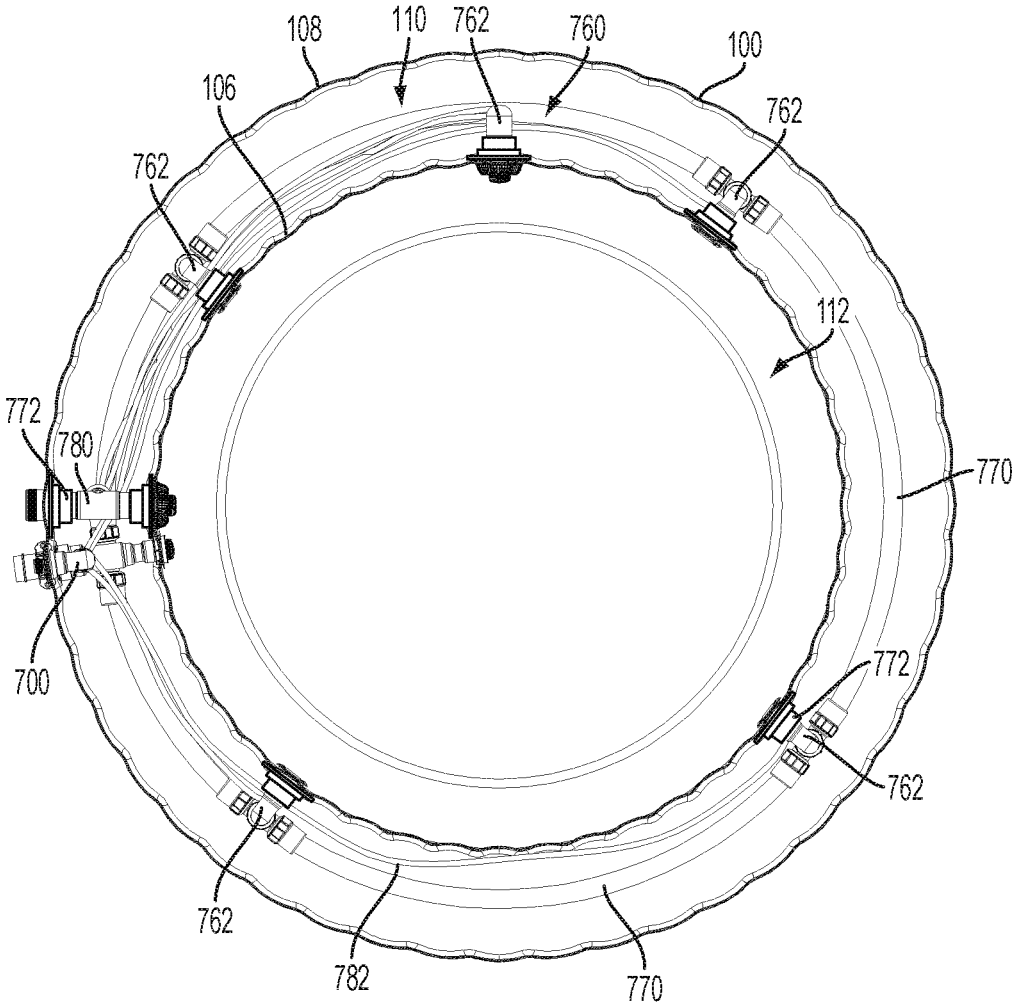
FIG. 41 is a top cross-sectional view of the spa of FIG. 39.

The jetted water pipe network 760 further includes a plurality of flexible sealing sleeves 772 to couple each spray nozzle 762 to the internal wall 106 of spa 100 in a sealed manner to prevent air and water leakage in spa 100 and to prolong the useful life of spa 100. The internal wall 106 of spa 100 may be sandwiched between each sealing sleeve 772 and the corresponding spray nozzle 762 in a sealed manner, as shown in FIG. 41. Each sealing sleeve 772 may have a stepped configuration including a small stem portion 774 and a large head portion 776 that forms a flange 778 around sealing sleeve 772. The small stem portion 774 of each sealing sleeve 772 may be coupled internally or externally to the corresponding spray nozzle 762 using suitable coupling techniques, such as high-frequency coupling, hot coupling (e.g., melting or injection molding), or adhering (e.g., gluing). The flange 778 on the large head portion 776 of each sealing sleeve 772 may be coupled to the internal wall 106 of spa 100 also suitable coupling techniques. According to an exemplary embodiment of the present disclosure, the material used to construct the sealing sleeves 772 may be the same as the material used to construct the internal wall 106 of spa 100, such as PVC, TPR, EVA, or TPU, for example. Such materials may be capable of being melted to seal the sealing sleeve 772 to its adjacent components and may be capable of undergoing thermal expansion without cracking.

The jetted water pipe network 760 further includes an air transport pipe 780. The air transport pipe 780 may be similar to the above-described air transport pipe 380 of FIGS. 23 and 24. In the illustrated embodiment of FIGS. 39-40, the air transport pipe 780 extends through the external wall 108, through the air chamber 110, and through the internal wall 106 of spa 100. Additional sealing sleeves 772 may be used to couple the air transport pipe to the external wall 108 and/or the internal wall 106 of spa 100 in a sealed manner.

The air transport pipe 780 may direct air directly into the water cavity 112 of spa 100. The air transport pipe 780 may also direct air indirectly into the water cavity 112 of spa 100 via the spray nozzles 762. In the illustrated embodiment of FIGS. 39-40, the air transport pipe 780 pulls air from the surrounding atmosphere, directs the air through an annular and flexible connecting pipe 782, and injects the air into the air hole 768 of each spray nozzle 762 under the suction force of the water flowing through the spray nozzle 762. The air from the air transport pipe 780 mixes with the water in the spray nozzle 762 to spray jetted water into the water cavity 112 of spa 100. The flexible nature of the connecting pipe 782 may allow the deflated spa 100 to be folded for storage and/or transport.

It is also within the scope of the present disclosure that the air transport pipe 780 may communicate with an air pump (e.g., air pump 232 of FIGS. 15-18), as discussed above in the "Bubble Embodiment" section. In this embodiment, the air transport pipe 780 may also deliver massaging air bubbles to spa 100.

Returning to FIG. 27, the controller (not shown) of the control system 500 may ensure that the electric current of the control system 500 stays below a predetermined limit, such as a standard household limit of 13 A to 16 A. In one embodiment, the controller may limit the power supply to one or more other units of the control system 500 when the jetted water pump 534 is activated, and the controller may restore the power supply to the other units of the control system when the jetted water pump 534 is deactivated. For example, the controller may automatically limit the power supply to the heating unit (not shown) to about 50% or less when the jetted water pump 534 is activated, and the controller may automatically restore the power supply to the heating unit to 100% when the jetted water pump 534 is deactivated. The controller may further limit the power supply to the heating unit to 0% when both the jetted water pump 534 and an additional air pump are activated.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An inflatable spa comprising:

a top wall;

a bottom wall;

an internal wall;

an external wall;

an inflatable air chamber defined by the top wall, the bottom wall, the internal wall, and the external wall;

a water cavity defined by the bottom wall and the internal wall; and a control system including an air pump operable in:

an inflation mode that supplies air to the air chamber to inflate the air chamber;

a deflation mode that removes air from the air chamber to deflate the air chamber; and an aeration mode that supplies air to the water cavity to aerate the water cavity.

2. The inflatable spa of claim 1, further comprising an air passageway between the air pump and the spa that extends above the water cavity of the spa.

3. The inflatable spa of claim 2, wherein the control system further includes a control panel assembly that receives a user input, wherein the control panel assembly is mounted to the air passageway at a location above the water cavity of the spa.

4. The inflatable spa of claim 2 wherein the air passageway includes a first check valve and a second check valve positioned in series to prevent a backflow of water from the water cavity of the spa to the air pump.

5. The inflatable spa of claim 4, wherein at least one of the first check valve and the second check valve becomes progressively tighter as water pressure from the water cavity of the spa increases.

6. An inflatable spa comprising:

a top wall;

a bottom wall;

an internal wall;

an external wall;

an inflatable air chamber defined by the top wall, the bottom wall, the internal wall, and the external wall;

a water cavity defined by the bottom wall and the internal wall;

a control system including an air pump; and an air passageway between the air pump and the spa, the air passageway including:

a first portion located adjacent to the air pump and below the top wall of the spa;

a second portion located above the top wall of the spa; and a third portion located outside of the external wall of the spa and below the top wall of the spa.

7. The inflatable spa of claim 6, wherein the control system further includes a control panel assembly that receives a user input, wherein the control panel assembly is mounted to the air passageway at a location above the water cavity of the spa.

8. The inflatable spa of claim 6, wherein the air passageway includes a first check valve and a second check valve positioned in series to prevent a backflow of water from the water cavity of the spa to the air pump.

9. The inflatable spa of claim 8, wherein at least one of the first check valve and the second check valve becomes progressively tighter as water pressure from the water cavity of the spa increases.

10. The inflatable spa of claim 6, wherein the air pump is operable in:

an inflation mode that supplies air to the air chamber to inflate the air chamber;

a deflation mode that removes air from the air chamber to deflate the air chamber; and an aeration mode that supplies air to the water cavity to aerate the water cavity.

11. An inflatable spa comprising:

a top wall;

a bottom wall;

an internal wall;

an external wall;

an inflatable air chamber defined by the top wall, the bottom wall, the internal wall, and the external wall;

a water cavity defined by the bottom wall and the internal wall;

a jetted water pipe network that delivers jetted water to the water cavity, wherein the jetted water pipe network is substantially concealed within the inflatable air chamber;

a control system; and a single water inlet pipe between the water cavity and the control system, wherein the water inlet pipe includes a first water passageway and a second water passageway.

12. The inflatable spa of claim 11, wherein the control system includes a drain assembly having:

a filtered water drain passageway in fluid communication with the first water passageway of the water inlet pipe;

a jetted water drain passageway in fluid communication with the second water passageway of the water inlet pipe; and an outlet in fluid communication with both the filtered water drain passageway and the jetted water drain passageway.

13. The inflatable spa of claim 11, further comprising a filtering cover that covers both the first water passageway and the second water passageway of the water inlet pipe.

14. The inflatable spa of claim 11, wherein the jetted water pipe network includes a plurality of spray nozzles, a first connecting pipe that delivers water to the plurality of spray nozzles, and a second connecting pipe that delivers air to at least one of the plurality of spray nozzles, wherein the plurality of spray nozzles, the first connecting pipe, and the second connecting pipe are substantially concealed within the inflatable air chamber.

15. The inflatable spa of claim 14, wherein the first and second connecting pipes are flexible.

16. The inflatable spa of claim 14, wherein the plurality of spray nozzles are spaced apart annularly about the internal wall of the spa.

17. The inflatable spa of claim 11, wherein the air chamber is inflated to a pressure greater than about 0.8 psi.

18. The inflatable spa of claim 17, wherein the pressure is about 1.5 psi.

19. The inflatable spa of claim 11, wherein:

the internal wall defines a single opening for the water inlet pipe, such that both the first and second water passageways extend through the single opening in the internal wall; and the external wall defines a single opening for the water inlet pipe, such that both the first and second water passageways extend through the single opening in the external wall.

20. The inflatable spa of claim 11, wherein the water inlet pipe includes a separating wall between the first and second water passageways, and wherein the first and second water passageways are parallel to each other.

21. The inflatable spa of claim 11, wherein the first water passageway is smaller in cross-section than the second water passageway.

22. An inflatable spa comprising:

a top wall;

a bottom wall;

an internal wall;

an external wall;

an inflatable air chamber defined by the top wall, the bottom wall, the internal wall, and the external wall;

a water cavity defined by the bottom wall and the internal wall;

a water pipe disposed in the inflatable air chamber;

an air pipe disposed in the inflatable air chamber; and a nozzle in communication with the water pipe, the air pipe, and the water cavity and configured to deliver water from the water pipe and air from the air pipe into the water cavity, wherein the nozzle is positioned above the water pipe and the air pipe.

23. The inflatable spa of claim 22, wherein the water pipe and the air pipe are flexible hoses.

24. The inflatable spa of claim 22, wherein the water pipe encircles the internal wall of the inflatable spa and is disposed on the bottom wall of the inflatable spa.

25. The inflatable spa of claim 22, wherein the water pipe and the air pipe extend vertically upward to connect with the nozzle.

26. The inflatable spa of claim 22, wherein the water travels from a first segment of the nozzle to a second segment of the nozzle, the second segment of the nozzle having a larger internal diameter than the first segment of the nozzle.

27. The inflatable spa of claim 22, wherein the nozzle includes a sealing sleeve with a stem portion coupled to the nozzle, a larger head portion coupled to the nozzle, and a flange portion sealed to the internal wall of the inflatable spa.

28. The inflatable spa of claim 22, wherein the air pipe communicates with an air transport pipe that extends through the external wall of the inflatable spa to receive air.

29. The inflatable spa of claim 22, wherein the nozzle pulls in air from the air pipe under a suction force from the water traveling through the nozzle.

30. The inflatable spa of claim 22, further comprising a second nozzle in communication with the water pipe.

* * * * *